US008684345B2

(12) United States Patent
Matsuo

(10) Patent No.: US 8,684,345 B2
(45) Date of Patent: Apr. 1, 2014

(54) PAPER-SHEET POST-PROCESSING DEVICE

(75) Inventor: Takeshi Matsuo, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 198 days.

(21) Appl. No.: 13/074,928

(22) Filed: Mar. 29, 2011

(65) Prior Publication Data

US 2011/0241275 A1 Oct. 6, 2011

(30) Foreign Application Priority Data

Mar. 31, 2010 (JP) ..... 2010-084129
Jun. 29, 2010 (JP) ..... 2010-148198

(51) Int. Cl.
*B65H 37/04* (2006.01)

(52) U.S. Cl.
USPC ..... 270/58.11; 270/58.17; 270/58.08; 399/410

(58) Field of Classification Search
USPC ..... 270/58.08, 58.11, 58.12, 58.14, 58.16, 270/58.17; 399/410
See application file for complete search history.

(56) References Cited

U.S. PATENT DOCUMENTS 6,209,864 B1 * 4/2001 Taniguchi et al. ..... 271/220
6,601,846 B2 * 8/2003 Saito et al. ..... 271/226
7,007,948 B2 3/2006 Hanada et al.
7,467,789 B2 * 12/2008 Murata et al. ..... 270/58.12
7,475,876 B2 1/2009 Hanada et al.
8,028,983 B2 * 10/2011 Taki et al. ..... 270/58.07
8,196,915 B2 * 6/2012 Hirabayashi et al. ..... 270/58.11
8,201,825 B2 6/2012 Hanada et al.
2006/0202402 A1 * 9/2006 Nagata et al. ..... 270/58.08
2006/0244192 A1 11/2006 Maruta
2009/0250861 A1 10/2009 Kimura
2010/0150636 A1 * 6/2010 Kubota et al. ..... 399/407
2011/0074081 A1 * 3/2011 Hirabayashi et al. ..... 270/58.12
2011/0103859 A1 * 5/2011 Kubo et al. ..... 399/395

FOREIGN PATENT DOCUMENTS

CN 1524777 A 9/2004
CN 1799977 A 7/2006
JP 2000-086056 3/2000
JP 2003-155159 5/2003
JP 2004-284756 10/2004
JP 2009-249098 10/2009

OTHER PUBLICATIONS

Office Action issued to corresponding Chinese Application No. 201110062403.5 mailed Jun. 25, 2013.

* cited by examiner

*Primary Examiner* — Patrick Mackey
(74) *Attorney, Agent, or Firm* — Knobbe Martens Olson & Bear LLP

(57) ABSTRACT

In a paper-sheet post-processing device, a paper-sheet aligning unit has: a main unit; a paper-sheet holding part which holds paper-sheets supported on a paper-sheet supporting unit; a cam mechanism which places the paper-sheet pressing part close to and separate from the paper-sheet supporting unit; and an aligning mechanism which aligns the paper-sheets supported on the paper-sheet supporting unit with a standard position by rotation of the aligning member; and the main unit has a rotation shaft rotatably supported axially by a first support part and a second support part and the cam member and aligning member are arranged to be fixed to the rotation shaft.

5 Claims, 21 Drawing Sheets

PAPER-SHEET POST-PROCESSING DEVICE

This application is based on and claims the benefit of priority from Japanese Patent Application No. 2010-148198, filed on 29 Jun. 2010 and Japanese Patent Application No. 2010-084129, filed on 31 Mar. 2010, the content of which is incorporated herein by reference.

BACKGROUND OF THE INVENTION

1. Field of the Invention

The present invention relates to a paper-sheet post-processing device which performs binding processing (staple processing) of sheets of paper on which images are formed by an image forming device such as a copying machine or printer.

2. Related Art

A paper-sheet post-processing device is generally arranged adjacent to an image forming device such as a copying machine or printer, and has a function of making a stack of sheets of paper by collecting sheets of paper on which images are formed in the image forming device, and performs single binding or multiple binding of this stack of sheets of paper (staple processing).

As a paper-sheet post-processing device which performs staple processing, for example, a technique (first conventional technique) is known which provides a bottom plate which supports sheets of paper fed from the image forming device, holds the sheets of paper supported on this bottom plate by a changeover claw, aligns the sheets of paper in a conveying direction by means of a hit roller part, and performs single binding or multiple binding processing using a stapler (staple processing).

Further, as a paper-sheet post-processing device which performs staple processing, for example, a technique (second conventional technique) is known which provides a compile tray on which sheets of paper fed from an image forming device are stacked, and aligns these sheets of paper supported on this compile tray, by means of a compile paddle.

However, with the first conventional technique, the changeover claw for holding the sheets of paper supported on the bottom plate and the hit roller part for aligning the sheets of paper are driven by different driving units. Therefore, there is a problem in that the first conventional technique makes the paper-sheet post-processing device larger, and increases cost.

Further, with the second conventional technique, the compile paddle for aligning the sheets of paper is moved using a solenoid or lever to align the sheets of paper according to the number of sheets of paper to be stacked on the compile tray. However, there is a problem in that the second conventional technique has a complicated configuration for moving the compile paddle.

SUMMARY OF THE INVENTION

The present invention relates to a paper-sheet post-processing device, which includes a paper-sheet supporting unit, a staple unit and a paper-sheet aligning unit. The paper-sheet supporting unit, which is arranged on a conveying route guiding a sheet of paper conveyed from an image forming device, is configured to support the sheet of paper fed from the conveying route. The staple unit, which is arranged at a standard position of the paper-sheet supporting unit, is configured to execute binding processing of the sheet of paper supported by the paper-sheet supporting unit. The paper-sheet aligning unit is configured to align the sheet of paper supported by the paper-sheet supporting unit with the standard position. The paper-sheet aligning unit includes a main unit, a paper-sheet holding part, a cam mechanism and an aligning mechanism. The main unit, which is disposed opposite to the paper-sheet supporting unit, includes a first support part and a second support part that are arranged straddling the conveying route. The paper-sheet holding part, which is arranged on the main unit, is configured to hold the sheet of paper supported by the paper-sheet supporting unit. The cam mechanism, which includes a cam member rotatably arranged on the main unit, is configured to place the paper-sheet holding part close to and at a distance from the paper-sheet supporting unit by rotation of the cam member. The aligning mechanism, which includes an aligning member rotatably arranged on the main unit, is configured to align the sheet of paper supported by the paper-sheet supporting unit with the standard position by rotation of the aligning member. The main unit includes a rotation shaft which is rotatably supported axially by the first support part and the second support part, and the cam member and the aligning member are arranged to be fixed to the rotation shaft.

According to the present invention, it is possible to operate the paper-sheet holding part and the aligning member only by rotating the rotation shaft such that a sheet of paper supported by the paper-sheet supporting unit is aligned with the standard position and to hold aligned sheets of paper to perform the binding processing (staple processing) thereon. Therefore, according to the present invention, it is possible to perform the binding processing (staple processing) only by rotating the rotation shaft by means of a single driving unit. Accordingly, it is possible to allow the paper-sheet post-processing device to be simplified in configuration and reduced in size and cost.

DETAILED DESCRIPTION OF THE INVENTION

First Embodiment

Hereinafter, a paper-sheet post-processing device according to a first embodiment of the present invention will be described with reference to the accompanying drawings.

Figure 1:
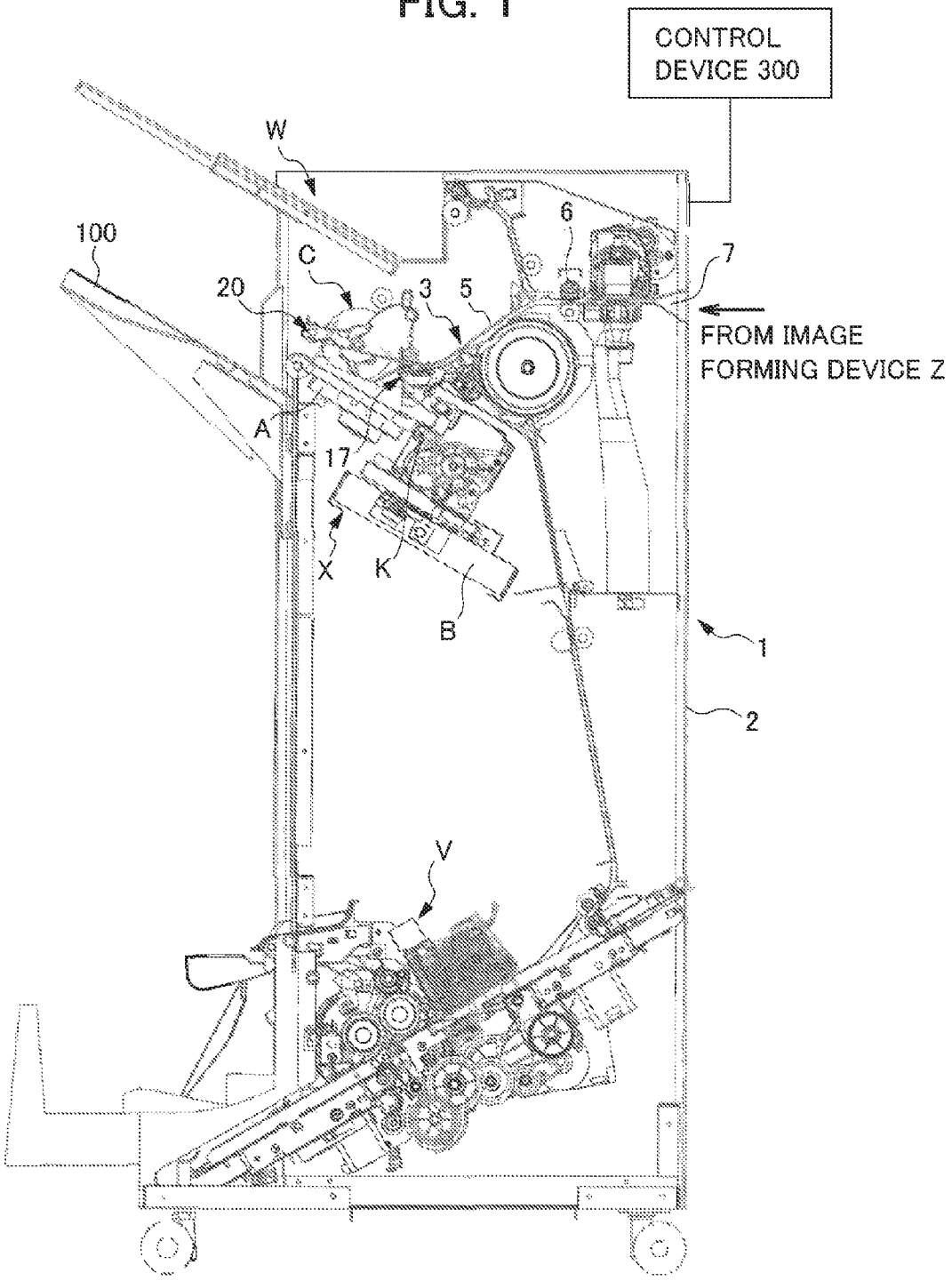
FIG. 1 is a schematic overall view of a paper-sheet post-processing device according to a first embodiment of the present invention.
Figure 2:
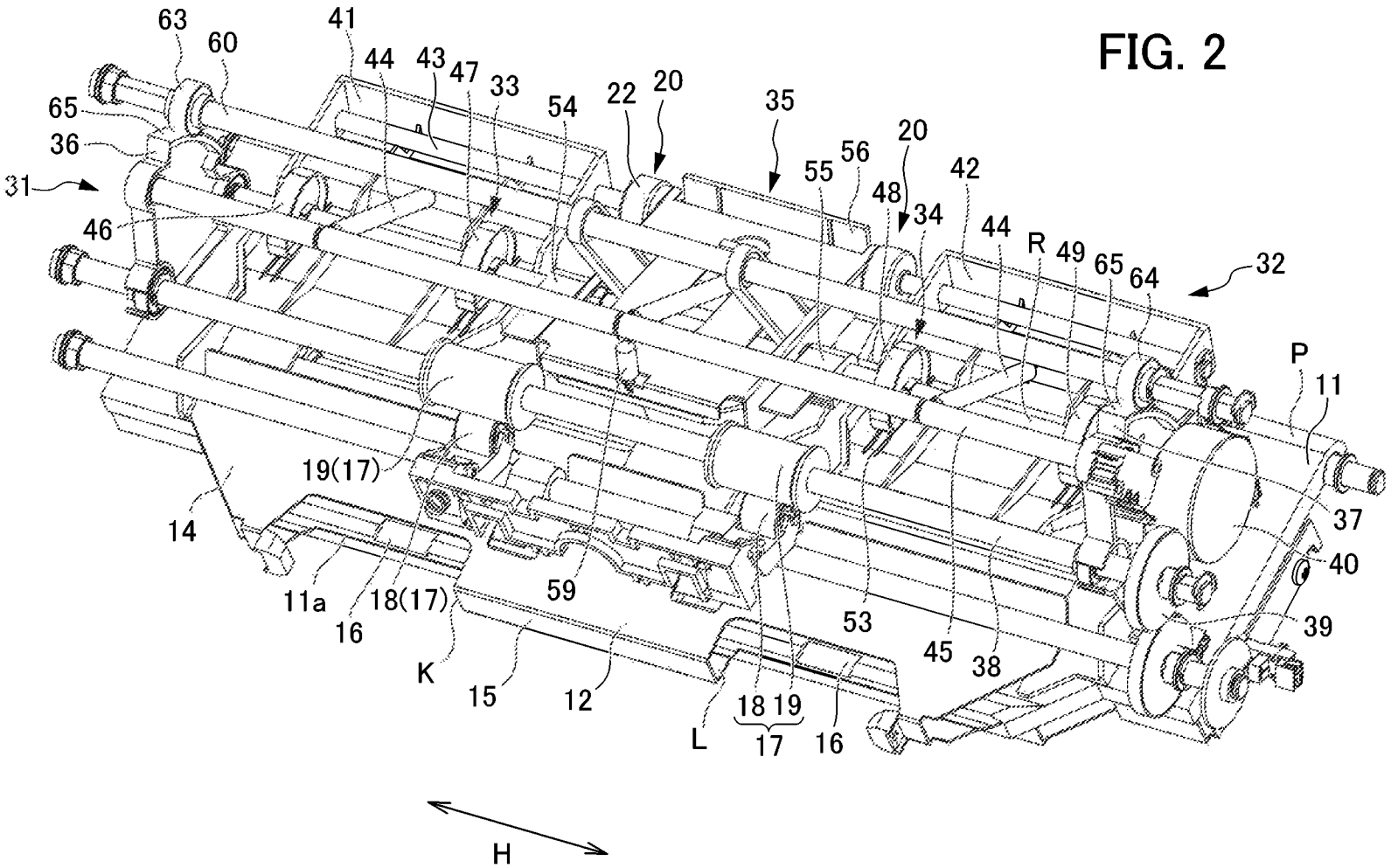
FIG. 2 is a view illustrating specific configurations of a paper-sheet supporting unit and a paper-sheet aligning unit illustrated in FIG. 1, and is a perspective view seen from a direction of feeding a sheet of paper.
Figure 3:
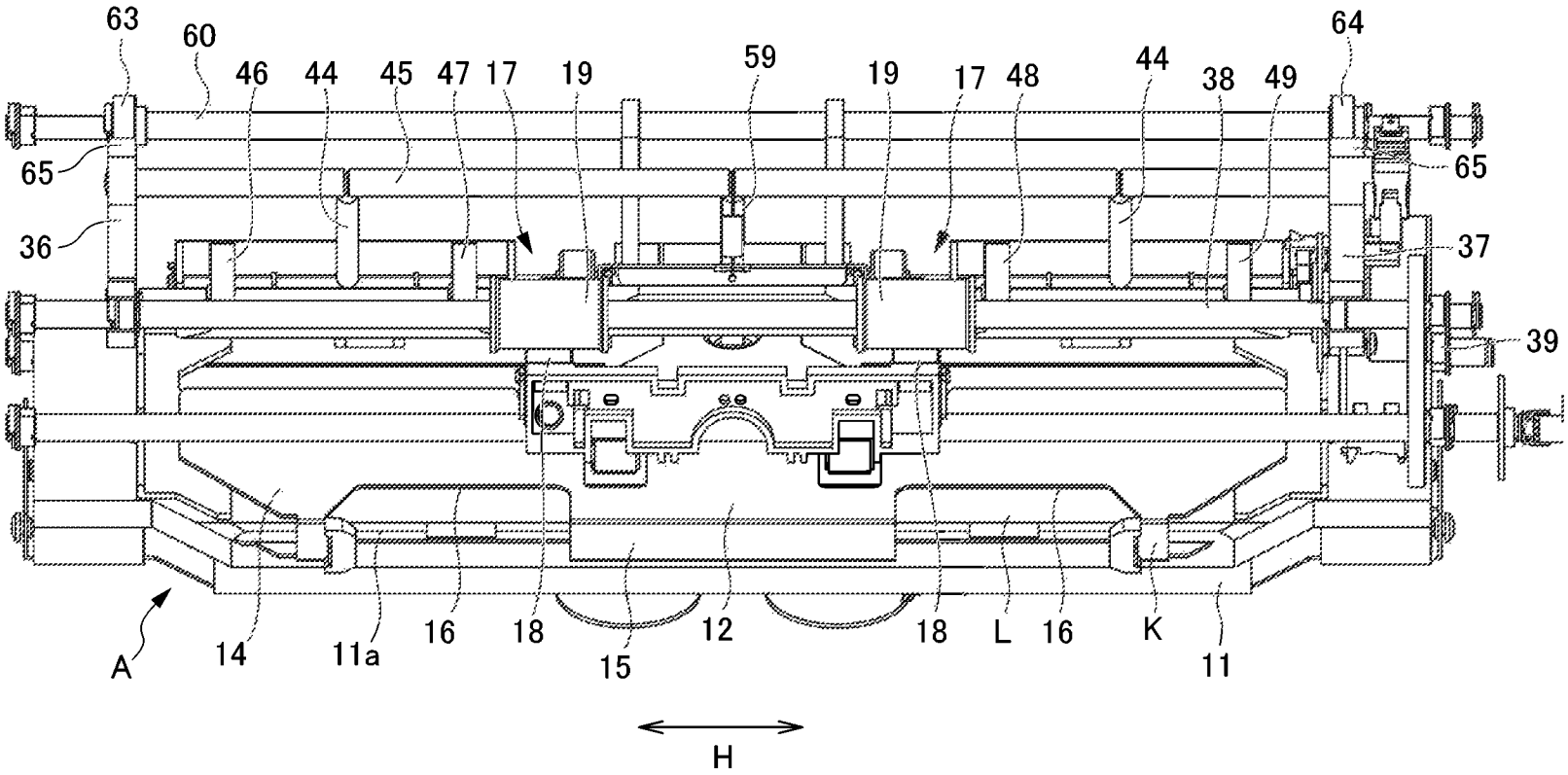
FIG. 3 is a view illustrating specific configurations of the paper-sheet supporting unit and the paper-sheet aligning unit illustrated in FIG. 1, and is a front view seen from a direction of feeding a sheet of paper.
Figure 4:
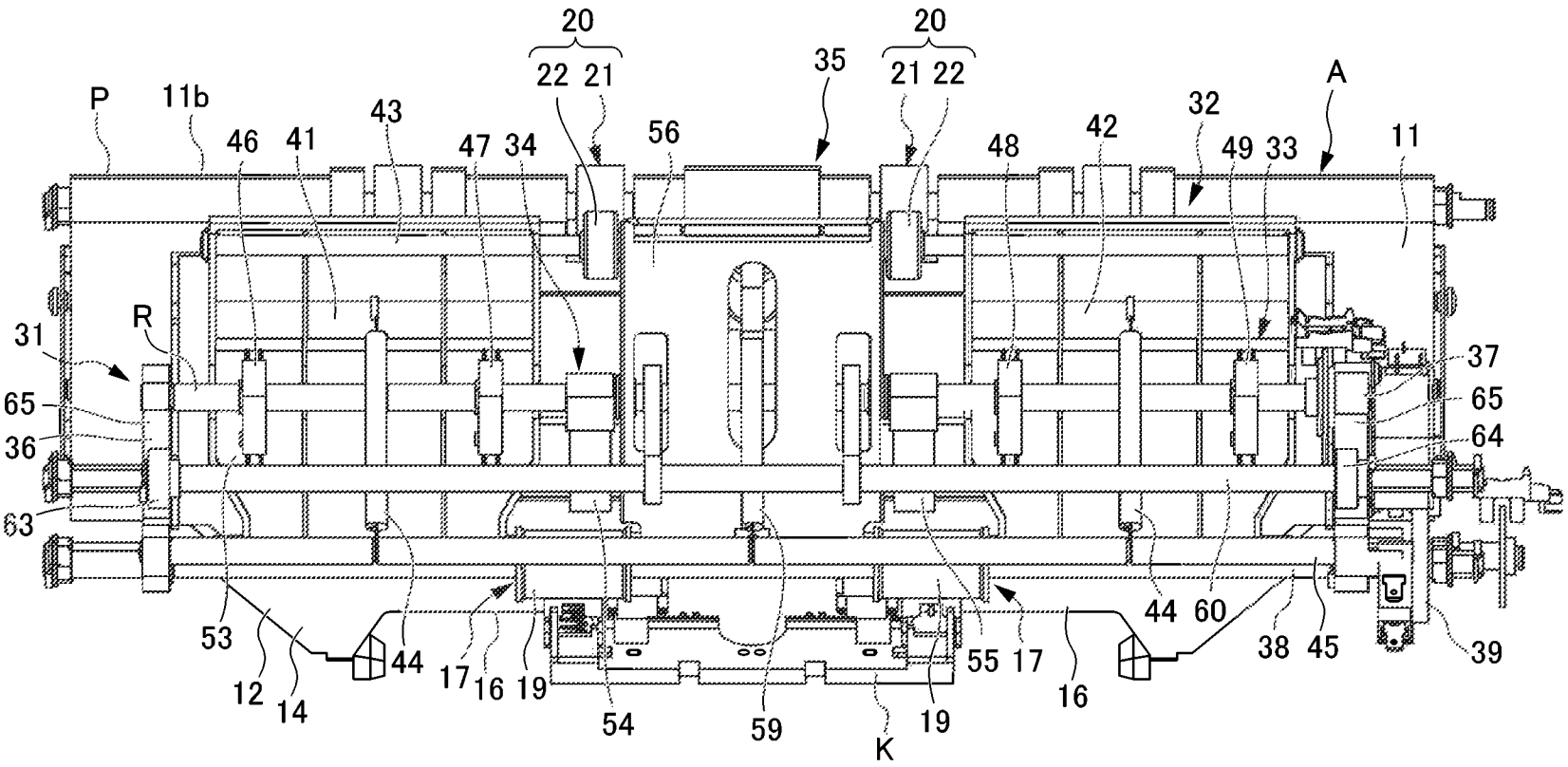
FIG. 4 is a plan view illustrating specific configurations of the paper-sheet supporting unit and the paper-sheet aligning unit illustrated in FIG. 1.
Figure 5:
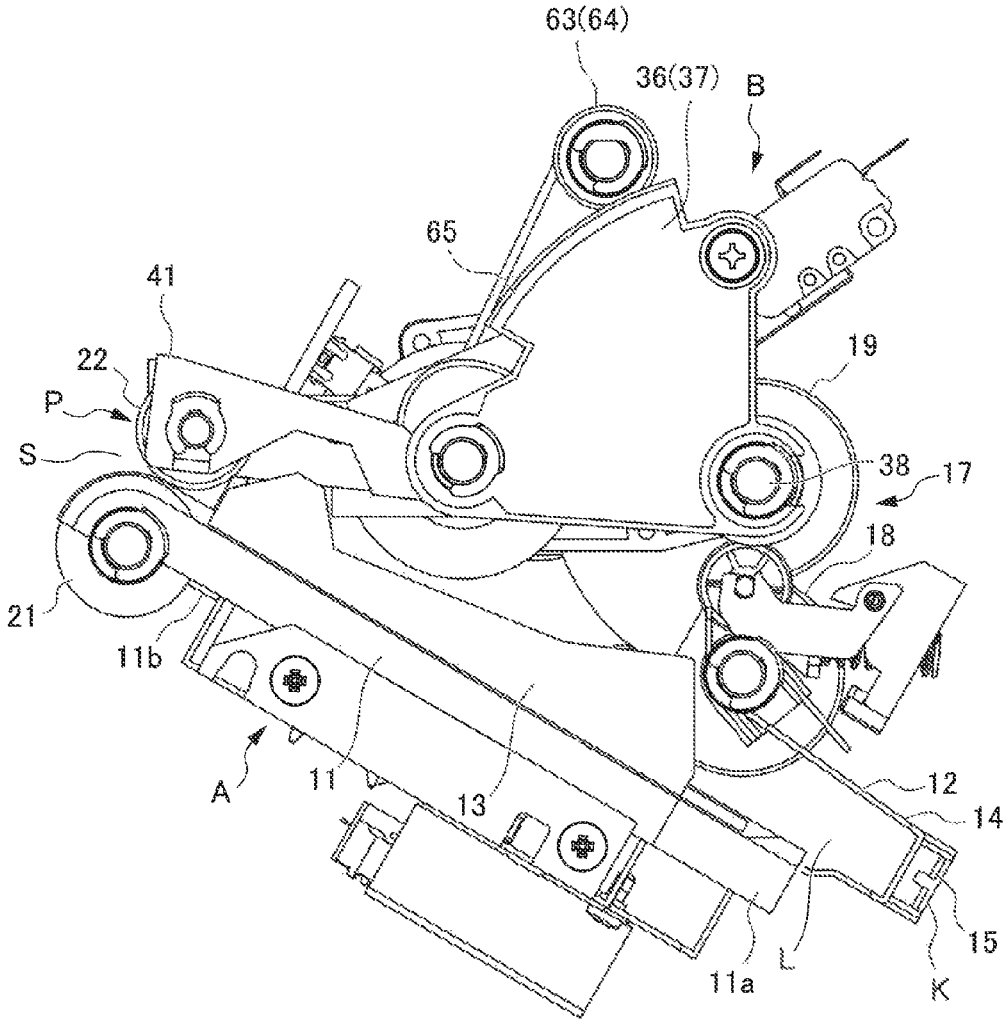
FIG. 5 is a side view illustrating specific configurations of the paper-sheet supporting unit and the paper-sheet aligning unit illustrated in FIG. 1.
Figure 6:
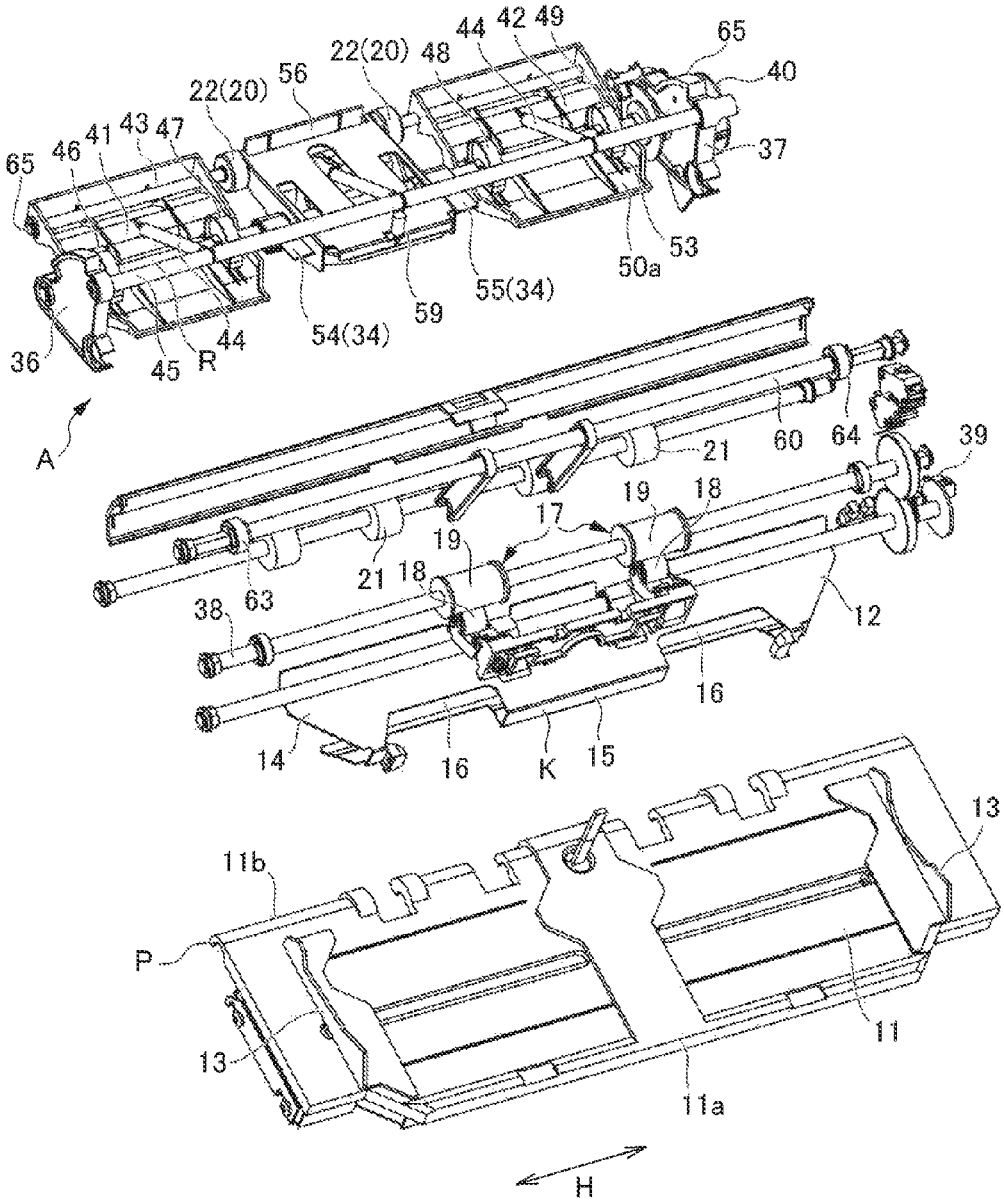
FIG. 6 is an exploded perspective view illustrating specific configurations of the paper-sheet supporting unit and the paper-sheet aligning unit illustrated in FIG. 1.

FIG. 1 is a schematic overall view of the paper-sheet post-processing device according to the first embodiment of the present invention. FIG. 2 is a view illustrating specific configurations of a paper-sheet supporting unit and a paper-sheet aligning unit illustrated in FIG. 1, and is a perspective view seen from a direction of feeding a sheet of paper. FIG. 3 is a view illustrating the specific configurations of the paper-sheet supporting unit and paper-sheet aligning unit illustrated in FIG. 1, and is a front view seen from the direction of feeding a sheet of paper. FIG. 4 is a plan view illustrating the specific configurations of the paper-sheet supporting unit and paper-sheet aligning unit illustrated in FIG. 1. FIG. 5 is a side view illustrating the specific configurations of the paper-sheet supporting unit and paper-sheet aligning unit illustrated in FIG. 1. FIG. 6 is an exploded perspective view illustrating the specific configurations of the paper-sheet supporting unit and paper-sheet aligning unit illustrated in FIG. 1.

Figure 7A:
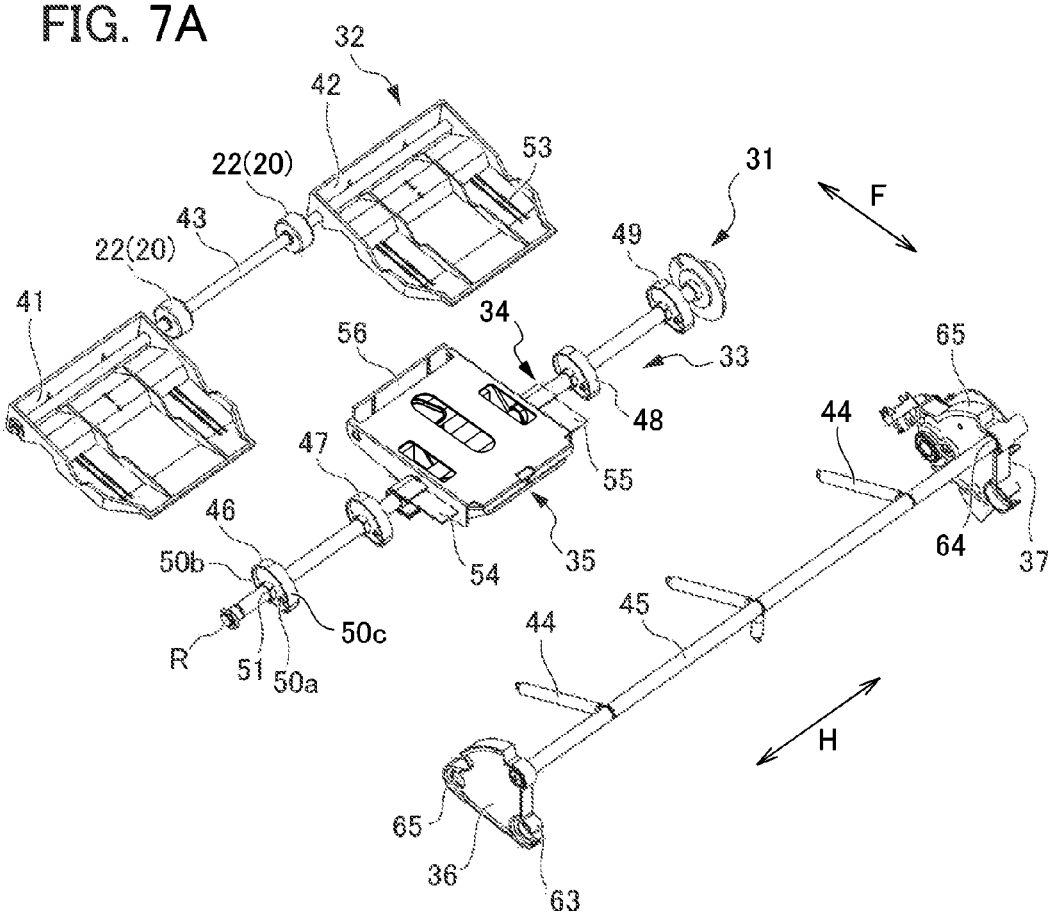
FIG. 7A is an exploded perspective view illustrating specific configurations of the paper-sheet aligning unit illustrated in FIG. 1.
Figure 7B:
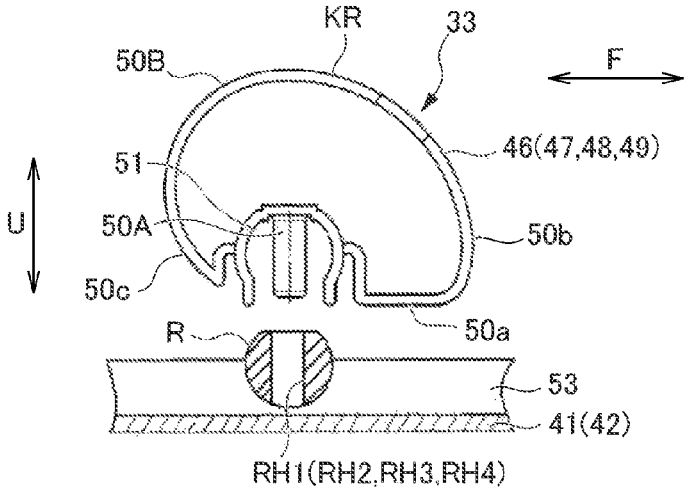
FIG. 7B is an exploded side view illustrating a cam mechanism.
Figure 8A:
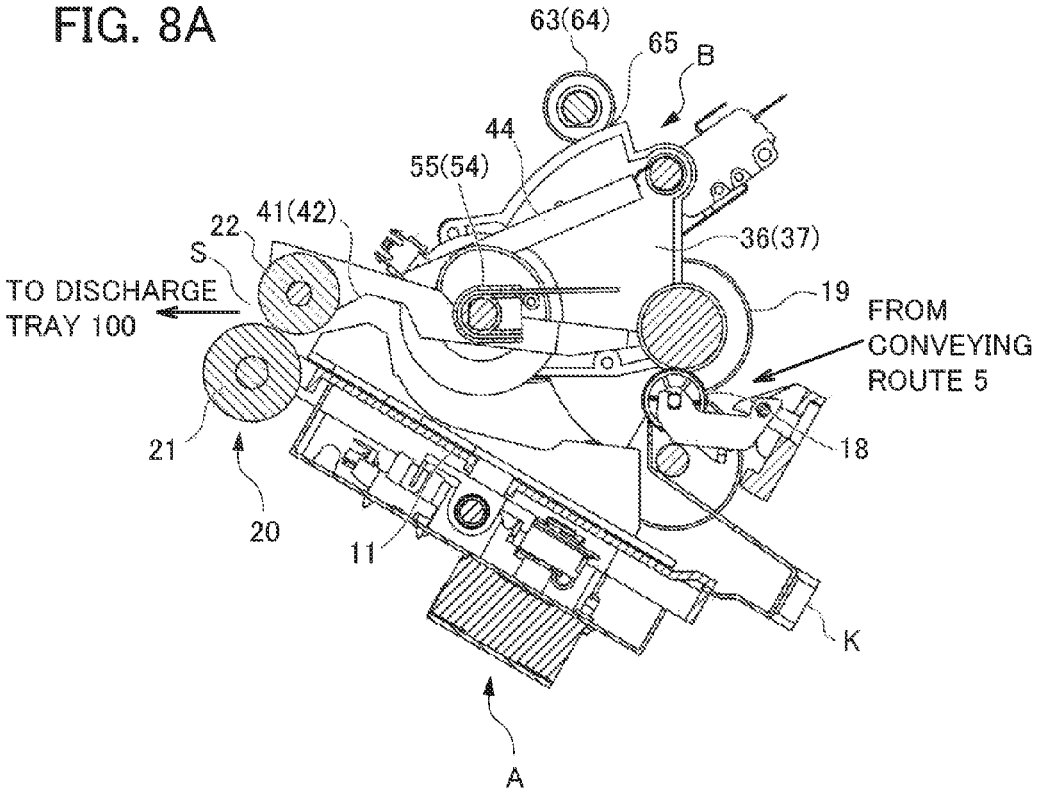
FIG. 8A is a view illustrating a pair of first discharge rollers and an aligning member after staple processing in the paper-sheet post-processing device illustrated in FIG. 1.
Figure 8B:
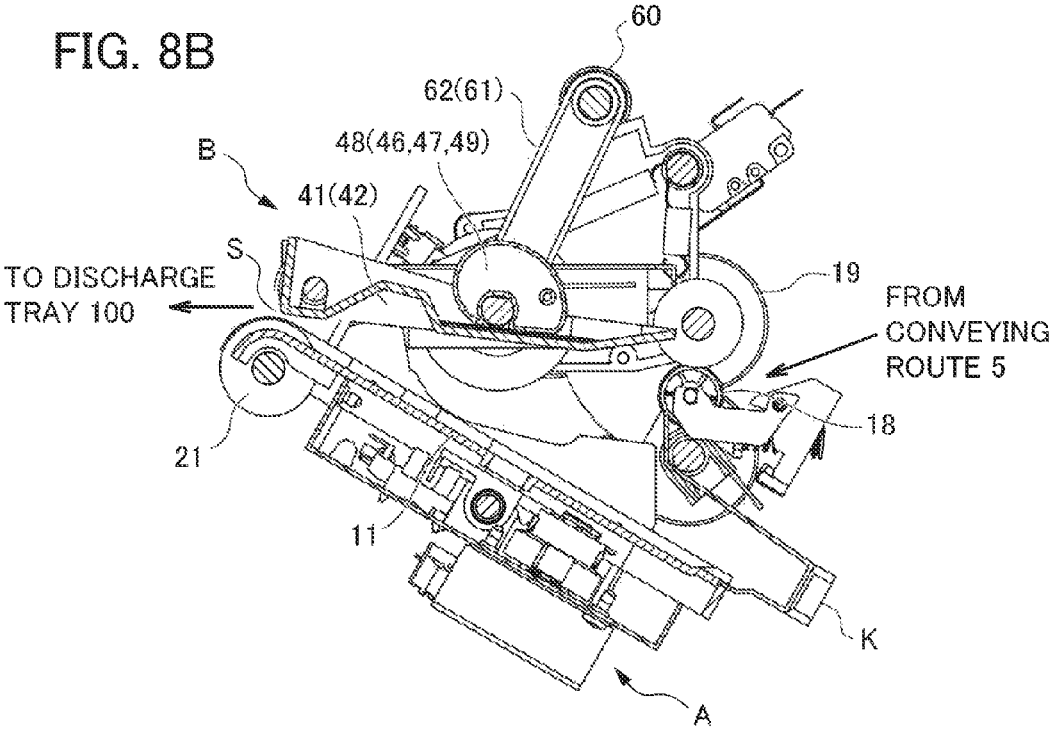
FIG. 8B is a view illustrating the pair of first discharge rollers and a cam member after staple processing in the paper-sheet post-processing device illustrated in FIG. 1.
Figure 9A:
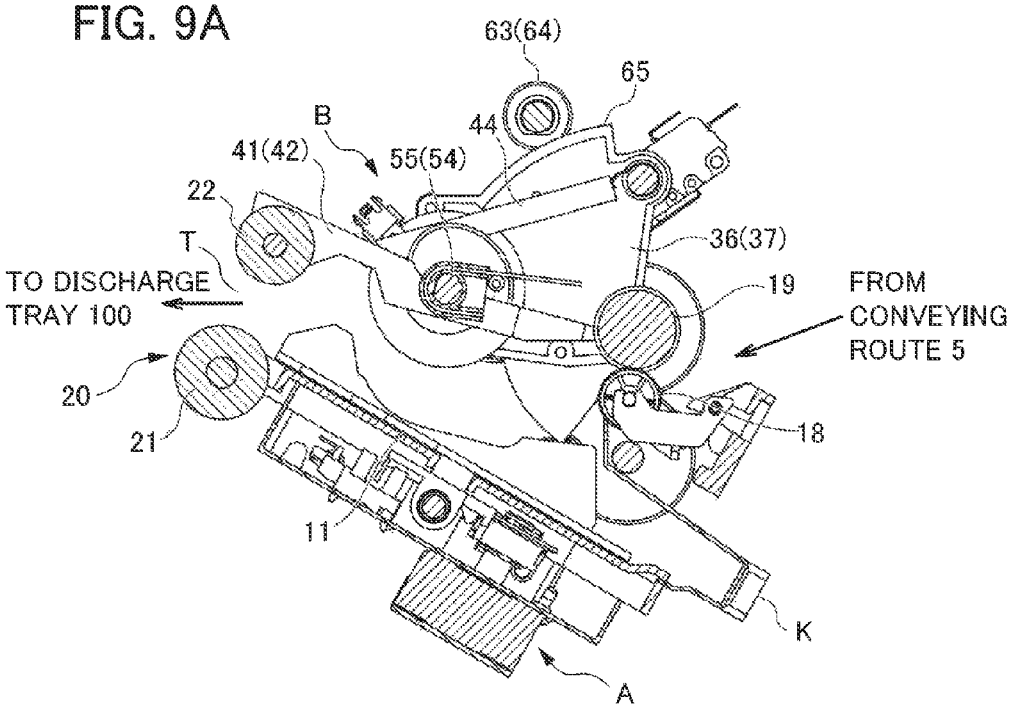
FIG. 9A is a view illustrating a staple processing operation in the paper-sheet post-processing device illustrated in FIG. 1, and is a view illustrating the aligning member at an initial stage of rotation.
Figure 9B:
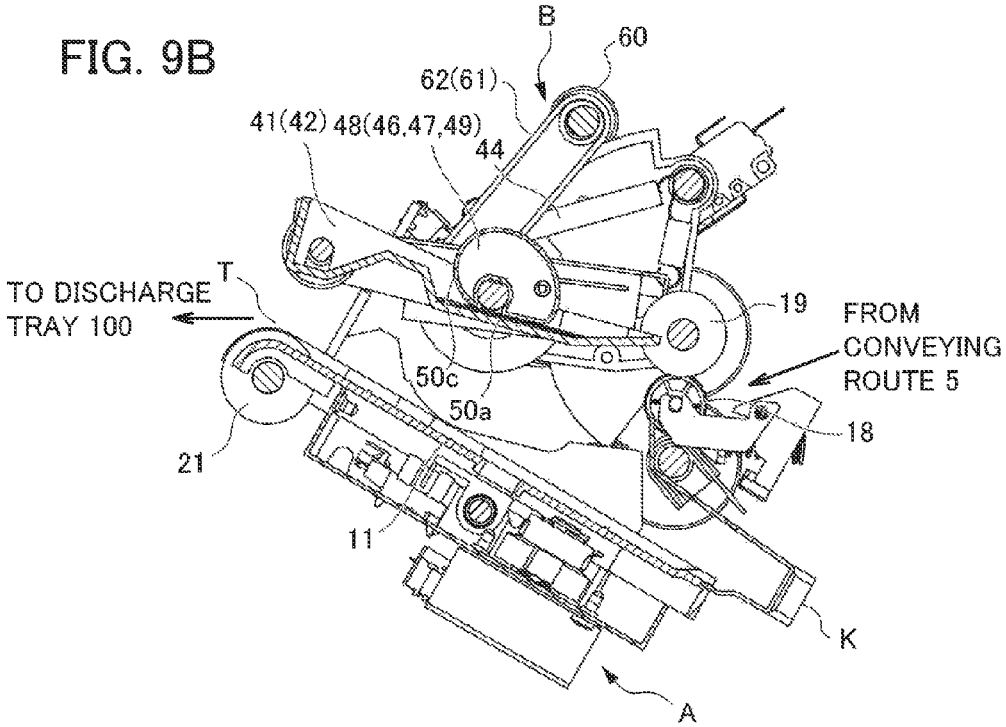
FIG. 9B is a view illustrating a staple processing operation in the paper-sheet post-processing device illustrated in FIG. 1, and is a view illustrating the cam member at an initial stage of rotation.
Figure 10A:
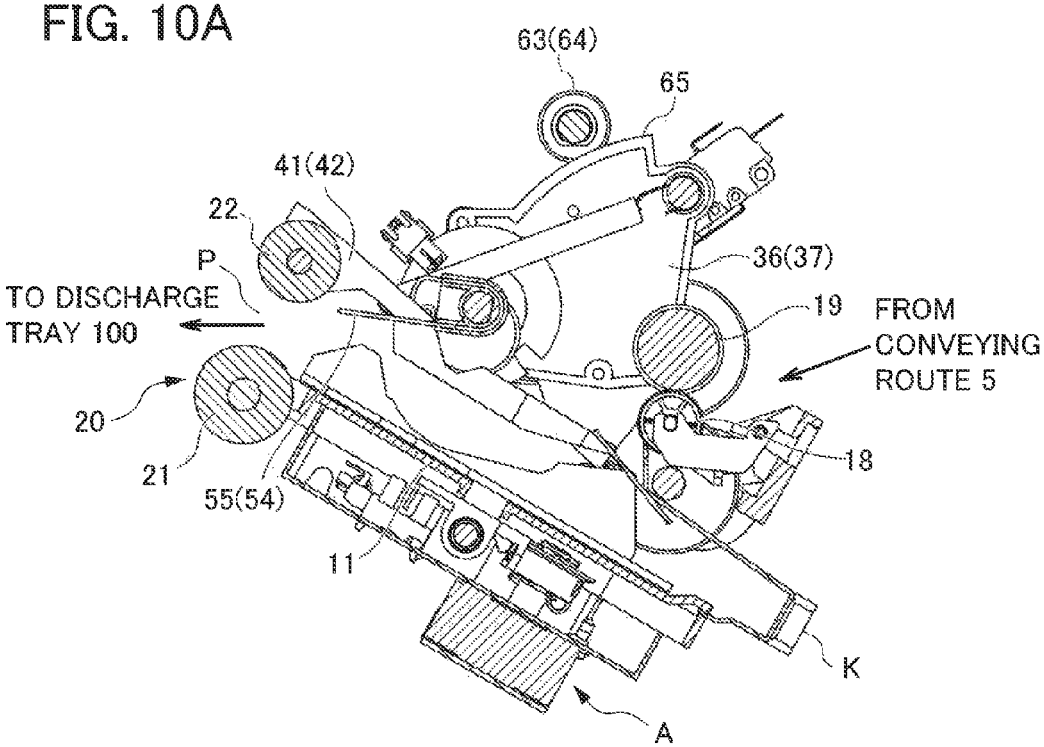
FIG. 10A is a view illustrating a staple processing operation in the paper-sheet post-processing device illustrated in FIG. 1, and is a view illustrating a state immediately before paper-sheets are pressed upon by the aligning member.
Figure 10B:
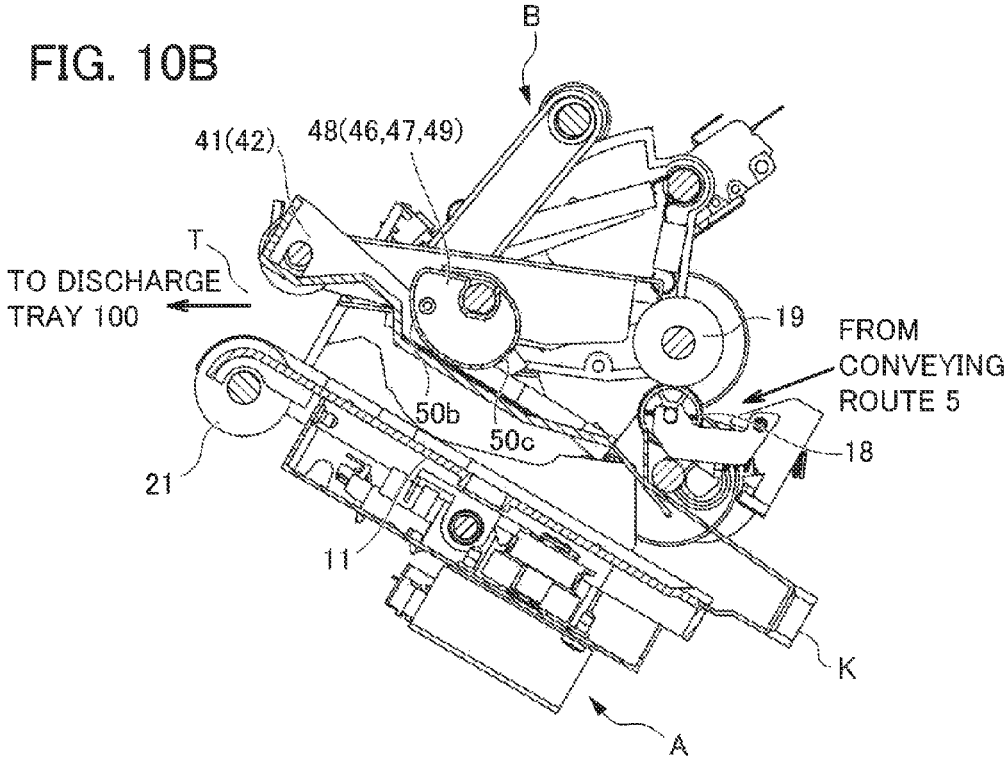
FIG. 10B is a view illustrating a staple processing operation in the paper-sheet post-processing device illustrated in FIG. 1, and is a view illustrating a state where sheets of paper are tapped down by a paper-sheet holding guide.

FIG. 7A is an exploded perspective view illustrating the specific configurations of the paper-sheet aligning unit illustrated in FIG. 1. FIG. 7B is an exploded side view illustrating a cam mechanism. FIG. 8A is a view illustrating a pair of first discharge rollers and an aligning member after staple processing in the paper-sheet post-processing device illustrated in FIG. 1. FIG. 8B is a view illustrating the pair of first discharge rollers and the cam member after staple processing in the paper-sheet post-processing device illustrated in FIG. 1. FIG. 9A is a view illustrating a staple processing operation in the paper-sheet post-processing device illustrated in FIG. 1, and is a view illustrating the aligning member at an initial stage of rotation. FIG. 9B is a view illustrating the staple processing operation in the paper-sheet post-processing device illustrated in FIG. 1, and is a view illustrating the cam member at the initial stage of rotation. FIG. 10A is a view illustrating the staple processing operation in the paper-sheet post-processing device illustrated in FIG. 1, and is a view illustrating a state immediately before sheets of paper are pressed on by the aligning member. FIG. 10B is a view illustrating the staple processing operation in the paper-sheet post-processing device illustrated in FIG. 1, and is a view illustrating a state where sheets of paper are tapped down by the paper-sheet holding guide.

As illustrated in FIG. 1, a paper-sheet post-processing device 1 according to the first embodiment is arranged adjacent to an image forming device Z. As illustrated in FIG. 1, the paper-sheet post-processing device 1 executes binding processing (staple processing) of sheets of paper on which images are formed and which are fed from the image forming device Z.

As illustrated in FIG. 1, the paper-sheet post-processing device 1 is configured to include a main cabinet 2, a conveying mechanism 3 and a staple processing device X.

As illustrated in FIG. 1, the paper-sheet post-processing device 1 is connected to a control device 300. The control device 300 controls staple processing.

As illustrated in FIG. 1, the conveying mechanism 3 is arranged in the main cabinet 2, and has a conveying route 5 and a pair of conveying rollers 6. As illustrated in FIG. 1, the conveying route 5 is formed between a feeding port 7 of the main cabinet 2 and the staple processing device X. Further, as illustrated in FIG. 1, the pair of conveying rollers 6 is provided on the conveying route 5, and arranged on a side closer to the feeding port 7 of the main cabinet 2.

As illustrated in FIG. 1, sheets of papers conveyed from the image forming device Z are conveyed to the staple processing device X by rotation of the pair of rollers 6 while being guided on the conveying route 5.

In addition, as illustrated in FIG. 1, the conveying route 5 branches off in a paper-sheet discharging part W and a booklet processing device V, so that it guides the sheets of paper conveyed from the image forming device Z to the paper-sheet discharging part W or booklet processing device V.

Next, the staple processing device X will be described with reference to FIGS. 1 to 7B.

Schematic Configuration of Staple Processing Device X

In FIG. 1, the staple processing device X is configured to include a paper-sheet supporting unit A, a staple unit B and a paper-sheet aligning unit C.

As illustrated in FIG. 1, the paper-sheet supporting unit A is arranged on the conveying route 5 in the main cabinet 2, and is positioned in an upper part of the main cabinet 2. As illustrated in FIG. 1, the paper-sheet supporting unit A supports the sheets of paper fed from the conveying route 5.

As illustrated in FIG. 1, the staple unit B is arranged at a standard position K of the paper-sheet supporting unit A. At this standard position K, the staple unit B executes binding processing (staple processing) of the sheets of paper supported by the paper-sheet supporting unit A. This binding processing (staple processing) includes single binding and multiple binding of sheets of paper.

As illustrated in FIG. 1, the paper-sheet aligning unit C causes the sheets of paper supported by the paper-sheet supporting unit A to be aligned with the standard position K.

As illustrated in FIG. 1, the sheets of paper bound by the staple processing device X are discharged to a discharge tray 100 outside the main cabinet 2.

Next, specific configurations of the paper-sheet supporting unit A and paper-sheet aligning unit C forming the staple processing device X will be described with reference to FIGS. 1 to 7B.

Specific Configuration of Sheet Supporting Unit A

As illustrated in FIGS. 2 to 6, the paper-sheet supporting unit A has a processing tray 11 and a standard cover member 12.

As illustrated in FIG. 6, the processing tray 11 supports some types of sheets of paper to be fed, and has guide members 13 on both ends of a paper-sheet width direction H. As illustrated in FIG. 6, these guide members 13 are movable in the width direction H such that the guide members 13 are adaptable to paper-sheet sizes (for example, A4 size and B5 size).

As illustrated in FIGS. 2 to 6, the standard cover member 12 has an upper cover plate 14 and a front cover plate 15 orthogonal to the upper cover plate 14, and is attached to the processing tray 11*a* on a side closer to a front end 11*a* (feeding side).

Accordingly, as illustrated in FIGS. 2 to 6, a standard space L for aligning sheets of paper is formed between the standard cover member 12 and processing tray 11. Further, as illustrated in FIGS. 2 to 4 and FIG. 6, the standard cover member 12 establishes a standard position K by means of the front cover plate 15. The standard cover member 12 makes the sheets of paper supported on the processing tray 11 abut the front cover plate 15, such that the sheets of paper are aligned.

Further, as illustrated in FIGS. 2 to 4 and FIG. 6, staple inserting ports 16 are formed in the standard cover member 12. As illustrated in FIGS. 2 to 6, the staple inserting ports 16 are formed across the upper cover plate 14 and front cover plate 15 of the standard cover member 12, and have openings in the standard space L. Further, as illustrated in FIGS. 2 to 4 and FIG. 6, the staple inserting ports 16 are formed spaced at an interval in the width direction H.

In the staple inserting ports 16, a binding mechanism (not illustrated) of the staple unit B illustrated in FIG. 1 is inserted. The binding mechanism executes binding processing (staple processing) of the sheets of paper aligned at the standard position K.

Further, as illustrated in FIGS. 2 to 6, the paper-sheet supporting unit A has feed rollers 18 forming a pair of feed rollers 17, and first discharge rollers 21 forming a pair of first discharge rollers 20.

As illustrated in FIGS. 2 to 6, each feed roller 18 is rotatably provided above the upper cover plate 14 of the standard cover member 12.

As illustrated in FIG. 6, the first discharge rollers 21 are rotatably provided to the processing tray 11, and are arranged at a discharge position P. The discharge position P is positioned on a side closer to a rear end 11*b* opposite to the standard position K in the processing tray 11.

Specific Configuration of Sheet Aligning Unit C

As illustrated in FIGS. 2 to 7B, the paper-sheet aligning unit C has a main unit 31, a paper-sheet holding part 32, a rotation shaft R, a cam mechanism 33, an aligning mechanism 34 and a discharging unit 35.

Configuration of Main Unit 31

As illustrated in FIGS. 2 to 6, the main unit 31 is disposed opposite to the processing tray 11 of the paper-sheet supporting unit A separated by an interval. As illustrated in FIGS. 2 to 6, the main unit 31 has a first support part 36 and second support part 37, and feed rollers 19 forming a pair of feed rollers 17. The first support part 36 and second support part 37 are arranged straddling the conveying route 5 in the width direction H of sheets of paper supported by the processing tray 11.

Further, as illustrated in FIGS. 2 to 6, the first support part 36 and second support part 37 of the main unit 31 have gear parts 65, respectively, having a fan-like outer peripheral shape. As illustrated in FIGS. 2 to 6, the gear parts 65 mesh with gears 63 and 64, respectively. As illustrated in FIGS. 2 to 4, the gears 63 and 64 are fixed to both ends of a transmission shaft 60. The transmission shaft 60 is linked to a discharge driving motor (not illustrated).

As illustrated in FIGS. 2 to 6, the gear parts 65 mesh with the gears 63 and 64, respectively in the support parts 36 and 37. Accordingly, as illustrated in FIG. 5, when the discharge driving motor (not illustrated) causes the transmission shaft 60 to normally rotate (clockwise rotation), the support parts 36 and 37 swing (rotate) to come closer to the processing tray 11 of the paper-sheet supporting unit A. Further, when the discharge driving motor (not illustrated) drives the transmission shaft 60 to reversely rotate (counterclockwise rotation), the support parts 36 and 37 swing (rotate) to be separated from the processing tray 11 of the paper-sheet supporting unit A.

Further, as illustrated in FIGS. 2 to 6, the feed rollers 19 forming the pair of feed rollers 17 are in pressure contact with the feed rollers 18 of the paper-sheet supporting unit A, respectively.

Furthermore, as illustrated in FIGS. 2 to 4 and FIG. 6, the feed rollers 19 are fixed and are arranged on a driving rotation shaft 38, respectively. As illustrated in FIGS. 2 to 4 and FIG. 6, the driving rotation shaft 38 is rotatably supported axially by the first support part 36 and second support part 37 of the main unit 31. The driving rotation shaft 38 is linked with an alignment driving motor 40 through a driving transmitting member 39. As illustrated in FIG. 2, the alignment driving motor 40 is attached to the second support part 37.

Configuration of Sheet Holding Part 32

As illustrated in FIGS. 2 to 7B, the paper-sheet holding part 32 is arranged on the main unit 31, and is composed of a plurality of paper-sheet holding guides 41 and 42.

As illustrated in FIGS. 2 to 4 and FIG. 6, the paper-sheet holding guides 41 and 42 are arranged at the discharge position P above the processing tray 11. As illustrated in FIGS. 2 to 4 and FIG. 6, the paper-sheet holding guides 41 and 42 are spaced at an interval in the width direction H, and are rotatably supported axially by a swing shaft 43. The swing shaft 43 is arranged on a rear end side of the discharge position P.

Further, as illustrated in FIGS. 2 to 4 and FIG. 6, the paper-sheet holding guides 41 and 42 are linked with coil springs 44 which are biasing members.

As illustrated in FIGS. 2 to 4 and FIG. 6, the coil springs 44 are attached to a support shaft 45. As illustrated in FIGS. 2 to 4 and FIG. 6, the support shaft 45 is arranged closer to the standard position K than the swing shaft 43, and is supported by the first support part 36 and second support part 37 of the main unit 31.

Accordingly, as illustrated in FIGS. 2 to 4 and FIG. 6, the paper-sheet holding guides 41 and 42 are supported by the support shaft 45 through the coil springs 44 on a side of the standard position K with respect to the swing shaft 43, and are arranged on the main unit 31.

Configuration of Rotation Shaft R

As illustrated in FIGS. 2 and 4, the rotation shaft R is arranged between the swing shaft 43 and support shaft 45, above the paper-sheet holding guides 41 and 42. Both ends of the rotation shaft R are supported axially by the first support part 36 and second support part 37. Further, as illustrated in FIG. 2, the rotation shaft R is linked to the alignment driving motor 40, and is driven to rotate by this alignment driving motor 40.

As illustrated in FIG. 7B, a plurality of attachment holes RH1 to RH4 are formed in the rotation shaft R. The attachment holes RH1 to RH4 penetrate in a direction (vertical direction U) orthogonal to an axis line of the rotation shaft R.

Further, as illustrated in FIGS. 2 and 4, the attachment holes RH1 to RH4 are spaced at intervals in the width direction H (axis line direction) of the rotation shaft R. In addition, the attachment holes RH1 and RH2 are formed opposite to the paper-sheet holding guide 41. The attachment holes RH3 and RH4 are formed opposite to the paper-sheet holding guide 42.

Configuration of Cam Mechanism 33

As illustrated in FIGS. 2 and 4, the cam mechanism 33 is configured to include a plurality of cam members 46 to 49.

As illustrated in FIG. 7B, the cam members 46 to 49 are arranged in the attachment holes RH1 to RH4 of the rotation shaft R, respectively. As illustrated in FIG. 7B, each of the cam members 46 to 49 is formed with an attachment shaft 50A and a cam 50B.

As illustrated in FIG. 7B, the attachment shaft 50A is fixed to the cam 50B. Further, as illustrated in FIG. 7B, an attachment shaft 50A of each of the cam members 46 to 49 is inserted in each of the attachment holes RH1 to RH4, from above the rotation shaft R, such that a cam 50B is arranged on each of the paper-sheet holding guides 41 and 42.

Accordingly, as illustrated in FIG. 7A, the cam members 46 to 49 are arranged on the rotation shaft R spaced at intervals in the axis line direction (width direction H) of the rotation shaft R. Simultaneously, the cam members 46 and 47 are arranged on the paper-sheet holding guide 41, as illustrated in FIG. 7A. Similarly, the cam members 48 and 49 are arranged on the paper-sheet holding guide 42.

As illustrated in FIG. 7B, in the cam 50B, an insertion recess 51 is formed. This insertion recess 51, which provides a space where the attachment shaft 50A is housed, is configured to open upon the rotation shaft R.

Further, the cam 50B is formed in a cam shape KR illustrated in FIG. 7B. As illustrated in FIG. 7B, the cam shape KR is composed of a straight outer peripheral shape 50*a* extending in a front-back direction F from an opening of the insertion recess 51, a first curved outer peripheral shape 50*b* continuing to the straight outer peripheral shape 50*a* and a second curved outer peripheral shape 50*c* continuing to the first curved outer peripheral shape 50*b* and reaching the opening of the insertion recess 51.

As illustrated in FIGS. 6 to 7B, with each of the cam members 46 to 49, an attachment shaft 50A is inserted in each of the attachment holes RH1 to RH4 of the rotation shaft R, such that a part connecting the straight outer peripheral shape 50*a* and first curved outer peripheral shape 50*b* of the cam shape KR is directed toward the standard position K. Further, accompanying insertion of the attachment shaft 50A, the insertion recess 51 mates with the outer periphery of the rotation shaft R.

Accordingly, the cam members 46 to 49 are each arranged on the rotation shaft R in a state where the straight outer peripheral shape 50*a* of the cam shape KR abuts each of the paper-sheet holding guides 41 and 42.

Further, as illustrated in FIGS. 2, 4 and 6, the cam members 46 to 49 are arranged inside guide grooves 53 of the paper-sheet holding guides 41 and 42.

Accordingly, as illustrated in FIG. 5, the paper-sheet holding guides 41 and 42 are maintained at initial positions where the paper-sheet holding guides 41 and 42 are prevented from rotating (swinging) toward the processing tray 11 using the swing shaft 43 as a support point.

Configuration of Aligning Mechanism 34

As illustrated in FIGS. 2, 4, 6 and 7A, the aligning mechanism 34 is arranged on the main unit 31, and has a plurality of aligning members 54 and 55.

As illustrated in FIGS. 2, 4, 6 and 7A, the aligning members 54 and 55 are arranged spaced at an interval in the width direction H, and are positioned between the cam member 47 and cam member 48. As illustrated in FIGS. 2, 4, 6 and 7A, the aligning members 54 and 55 are fitted to the outer periphery of the rotation shaft R, and are fixed to the rotation shaft R. Further, as illustrated in FIGS. 2, 4 and 6, the aligning members 54 and 55 are shaped like a plate extending toward the standard position K.

Accordingly, as illustrated in FIGS. 2, 4, 6 and 7A, the aligning members 54 and 55 and cam members 46 to 49 are coaxially fixed to the rotation shaft R.

As illustrated in FIGS. 2, 4 and 6, the aligning members 54 and 55 are driven by the alignment driving motor 40 to rotate together with the rotation shaft R and cam members 46 to 49. In addition, the aligning members 54 and 55 cause the sheets of paper supported on the processing tray 11 to move while pressing the sheets of paper from a side closer to the discharge position P of the processing tray 11 such that the sheets of paper are aligned with the standard position K.

Configuration of Discharging Unit 35

As illustrated in FIGS. 2, 4, 6 and 7A, the discharging unit 35 is arranged on the main unit 31. As illustrated in FIGS. 2, 4, 6 and 7A, the discharging unit 35 has a discharging main unit 56, and second discharge rollers 22 forming the pair of first discharge rollers 20.

As illustrated in FIGS. 2, 4, 6 and 7A, the discharging main unit 56 is provided between the paper-sheet holding guides 41 and 42, and forms an arrangement space between the paper-sheet holding guides 41 and 42. As illustrated in FIGS. 2, 4 and 6, the aligning members 54 and 55 and second discharge rollers 22 are arranged in this arrangement space. As illustrated in FIGS. 2, 4 and 6, the second discharge rollers 22 are arranged on the swing shaft 43 opposite to the first discharge rollers 21 of the paper-sheet supporting unit A.

As illustrated in FIGS. 2, 4, 6 and 7A, the discharging main unit 56 is axially supported by the swing shaft 43, and is supported by the support shaft 45 through a coil spring 59. As illustrated in FIGS. 2 and 4, the coil spring 59 bridges between a front end of the discharging main unit 56 on a side directed to the standard position K and the support shaft 45.

As illustrated in FIGS. 2 to 4, 6 and 7A, the discharging unit 35 is supported by the support shaft 45 through the coil spring 59. Both ends of the support shaft 45 are supported axially by the first support part 36 and second support part 37 of the main unit 31.

Further, in FIGS. 2 to 4, when the driving motor (not illustrated) causes the transmission shaft 60 to normally rotates (in the clockwise direction) such that the support parts 36 and 37 swing (rotate) to be closer to the processing tray 11, the discharging unit 35 also moves accompanying swinging (rotation) of the support parts 36 and 37. In this way, the second discharge rollers 22 of the discharging unit 35 are brought into pressure contact (nipped) with the first discharge rollers 21 of the paper-sheet supporting unit A (see FIG. 5).

Further, when the support parts 36 and 37 swing (rotate) to be separated from the processing tray 11, the discharging unit 35 also moves accompanying swinging (rotation) of the support parts 36 and 37. Consequently, the second discharge rollers 22 of the discharging unit 35 can be separated (release nipping) from the first discharge rollers 21 and 21.

Accordingly, accompanying rotation of the main unit 31, the discharging unit 35 moves to a pressured position S and a separated position T. The pressured position S is where the second discharge rollers 22 are in pressure contact with the first discharge rollers 21 (see FIG. 5). On the other hand, the separated position T is where the second discharge rollers 22 are separated from the first discharge rollers 21 (see FIG. 9).

Staple Processing Operation

Next, a staple processing operation of the paper-sheet post-processing device 1 according to the first embodiment will be described with reference to FIGS. 1 to 10B.

In addition, for ease of description, as illustrated in FIG. 8A, the second discharge rollers 22 are positioned in pressure contact with the first discharge rollers 21 and 21 (hereinafter referred to as "pressured position S"). As illustrated in FIG. 8A, the paper-sheet holding guides 41 and 42 and aligning members 54 and 55 are positioned to retreat in the paper-sheet aligning unit C (hereinafter referred to as "initial state").

In FIG. 1, the control device 300 receives a staple processing signal through an input operation by an operator (user). Further, as illustrated in FIGS. 8A to 9B, the control device 300 drives the discharge driving motor (not illustrated) to cause the transmission shaft 60 to reversely rotate (in the counterclockwise direction).

Accordingly, as illustrated in FIGS. 8A to 9B, the gear parts 65 mesh with the gears 63 and 64, so that the support parts 36 and 37 swing (rotate) to be separated from the processing tray 11. Accompanying this, the discharging unit 35 also swings (rotates) such that the second discharge rollers 22 are separated from the first discharge rollers 21.

Accordingly, the second discharge rollers 22 of the discharging unit 35 are separated from the first discharge rollers 21, and move from the pressured position S illustrated in FIGS. 8A and 8B to the separated position T illustrated in FIGS. 9A and 9B, thereby releasing pressure contact (nipping release).

In FIG. 1, the control device 300 drives the alignment driving motor 40 illustrated in FIGS. 2 and 6 to rotate the pair of feed rollers 17. At the same time, as illustrated in FIG. 4, the control device 300 causes the alignment driving motor 40 to drive the rotation shaft R to rotate.

As illustrated in FIG. 1, sheets of paper conveyed from the image forming device Z are fed to the paper-sheet supporting unit A by the pair of conveying rollers 6 and the pair of feed rollers 17 while being guided on the conveying route 5.

Further, as illustrated in FIGS. 9A and 9B, when the rotation shaft R rotates, the cam members 46 to 49 and aligning members 54 and 55 also rotate in the counterclockwise direction. As illustrated in FIGS. 9A and 9B, accompanying rotation of the cam members 46 and 47, the paper-sheet holding guides 41 and 42 move from the initial state towards the processing tray 11 while resisting the spring forces exerted by the coil springs 44.

With each of the cam members 46 to 49, the straight outer peripheral shape 50*a* illustrated in FIG. 9B abuts each of the paper-sheet holding guides 41 and 42. When each of the cam members 46 to 49 further rotates from this state and the second curved outer peripheral shape 50*c* abuts each of the paper-sheet holding guides 41 and 42, the paper-sheet holding guides 41 and 42 come closer toward the standard position K using the swing shaft 43 as the support point.

As illustrated in FIGS. 9A to 10B, the paper-sheet holding guides 41 and 42 swing at predetermined timing after the rear end of a sheet of paper passes the pair of feed rollers 17 (feed rollers 18 and 19).

Then, as illustrated in FIG. 10B, accompanying rotation of the cam members 46 to 49, the second curved outer peripheral shape 50*c* abuts each of the paper-sheet holding guides 41 and 42. As the cam members 46 to 49 further rotate from this state, the first curved outer peripheral shape 50*b* comes to abut each of the paper-sheet holding guides 41 and 42. In this manner, the paper-sheet holding guides 41 and 42 further swing to come closer to the processing tray 11.

According to a series of cam operations illustrated in FIGS. 8A to 10B, the paper-sheet holding guides 41 and 42 tap down sheets of paper fed from the conveying route 5 through the pair of feed rollers 17 onto the processing tray 11.

The sheets of paper tapped down by the paper-sheet holding guides 41 and 42 are supported on the processing tray 11. At this time, as illustrated in FIG. 1, a part of the sheets of paper reaches the discharge tray 100 from the pair of first discharge rollers 20. That is, the processing tray 11 supports another part of the sheets of paper.

By contrast with this, as illustrated in FIG. 10A, at timing when a sheet of paper fed from the conveying route 5 is supported on the processing tray 11, the aligning members 54 and 55 abut the sheet of paper to apply pressure to them from a side closer to the discharge position P of the processing tray 11. When the aligning members 54 and 55 under the condition described above further rotate, the sheet of paper supported on the processing tray 11 moves up to the standard position K of the processing tray 11 by rotation of the aligning members 54 and 55, so that the sheet of paper are aligned, abutting the front cover plate 15.

Further, when a plurality of sheets of paper is supported on the processing tray 11 and aligned by repeating the above processing steps, the binding mechanism (not illustrated) of the staple unit B illustrated in FIG. 1 is inserted in the staple inserting ports 16 illustrated in FIG. 2 to execute single binding and multiple binding (staple processing) of the plurality of sheets of paper.

As illustrated in FIGS. 8A to 9B, when staple processing is finished, the control device 300 illustrated in FIG. 1 drives the discharge driving motor (not illustrated) to cause the transmission shaft 60 to normally rotate (in the clockwise direction).

In this manner, as illustrated in FIGS. 8A to 9B, the gear parts 65 mesh with the gears 63 and 64, so that the support parts 36 and 37 swing (rotate) to come closer to the processing tray 11. Following this, the discharging unit 35 also swings (rotates) such that the second discharge rollers 22 come closer to the first discharge rollers 21.

Accordingly, the second discharge rollers 22 of the discharging unit 35 come closer to the first discharge rollers 21 and move from the separated position T illustrated in FIGS. 9A to 9B to the pressured position S illustrated in FIGS. 8A and 8B. In this manner, the sheets of paper to which staple processing has been applied are pressed (nipped) between the second discharge rollers 22 and first discharge rollers 21.

Further, when the first discharge rollers 21 are driven to rotate, the sheets of paper to which staple processing has been applied are discharged to the discharge tray 100 illustrated in FIG. 1.

According to the first embodiment, for example, the following effect is provided.

According to the first embodiment, it is possible to hold the sheets of paper supported on the paper-sheet supporting unit A by means of the second discharge rollers 22. In addition, the discharging unit 35 rotates about the rotation shaft R to cause the second discharge rollers 22 to move to the pressured position S and separated position T of the first discharge rollers 21.

In this manner, the discharging unit 35 can align and hold the sheets of paper according to the number of the sheets of the paper supported on the paper-sheet supporting unit A. In addition, it is possible to move the discharging unit 35 with a simple configuration. Such a configuration is the most suitable when staple processing is applied to tens of sheets of paper in particular.

Second Embodiment

Next, a second embodiment of the present invention will be described. Differences of the second embodiment from the first embodiment will be mainly described, and components same as the first embodiment will be assigned the same reference numerals and description thereof will be omitted. Description of the first embodiment will be adequately applied to features of the second embodiment which will not be described in particular. The same effect as in the first embodiment is also provided in the second embodiment.

Figure 11:
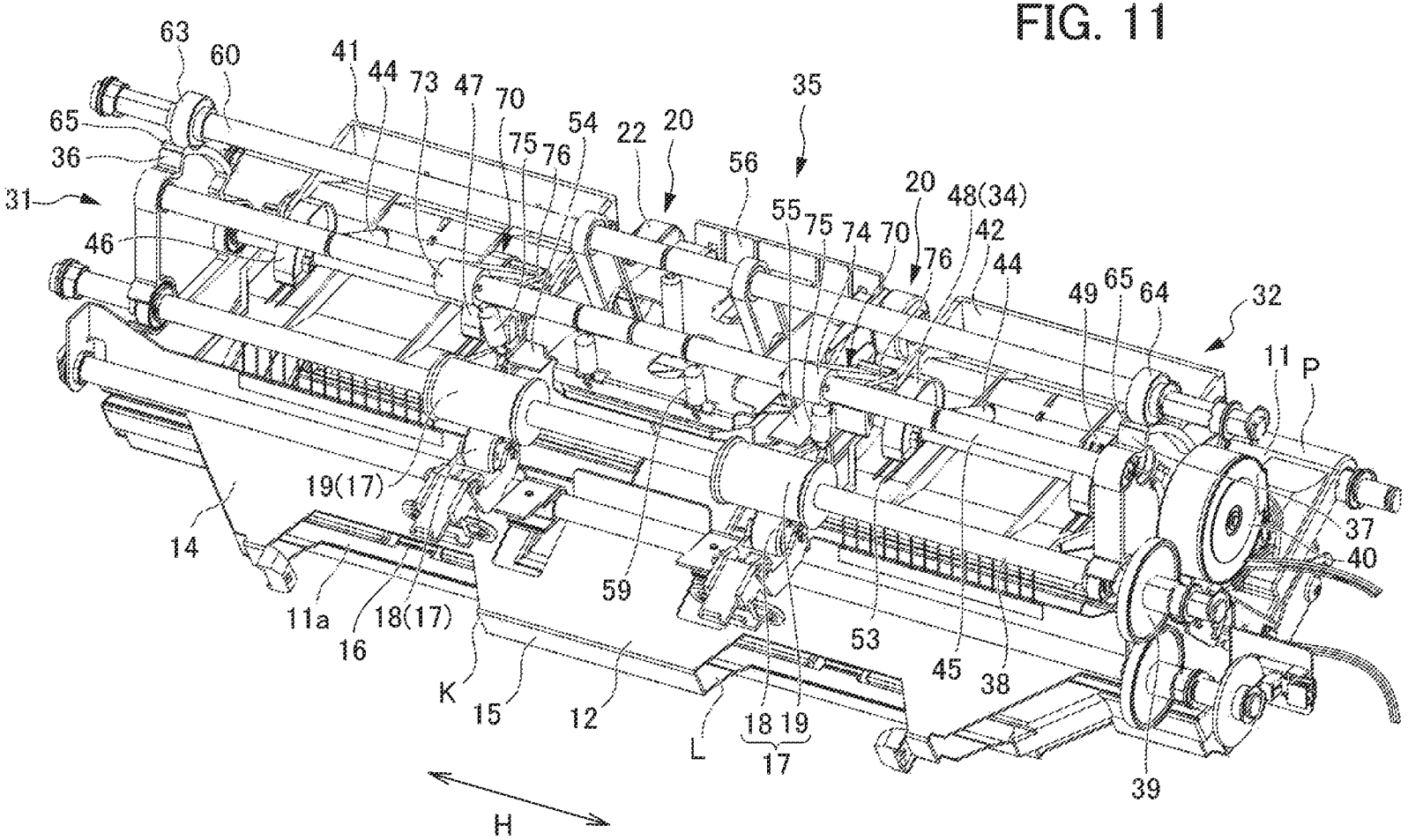
FIG. 11 is a view illustrating specific configurations of a paper-sheet supporting unit and a paper-sheet aligning unit in a second embodiment, and is a perspective view (corresponding to FIG. 2) seen from the direction feeding a sheet of paper.
Figure 12:
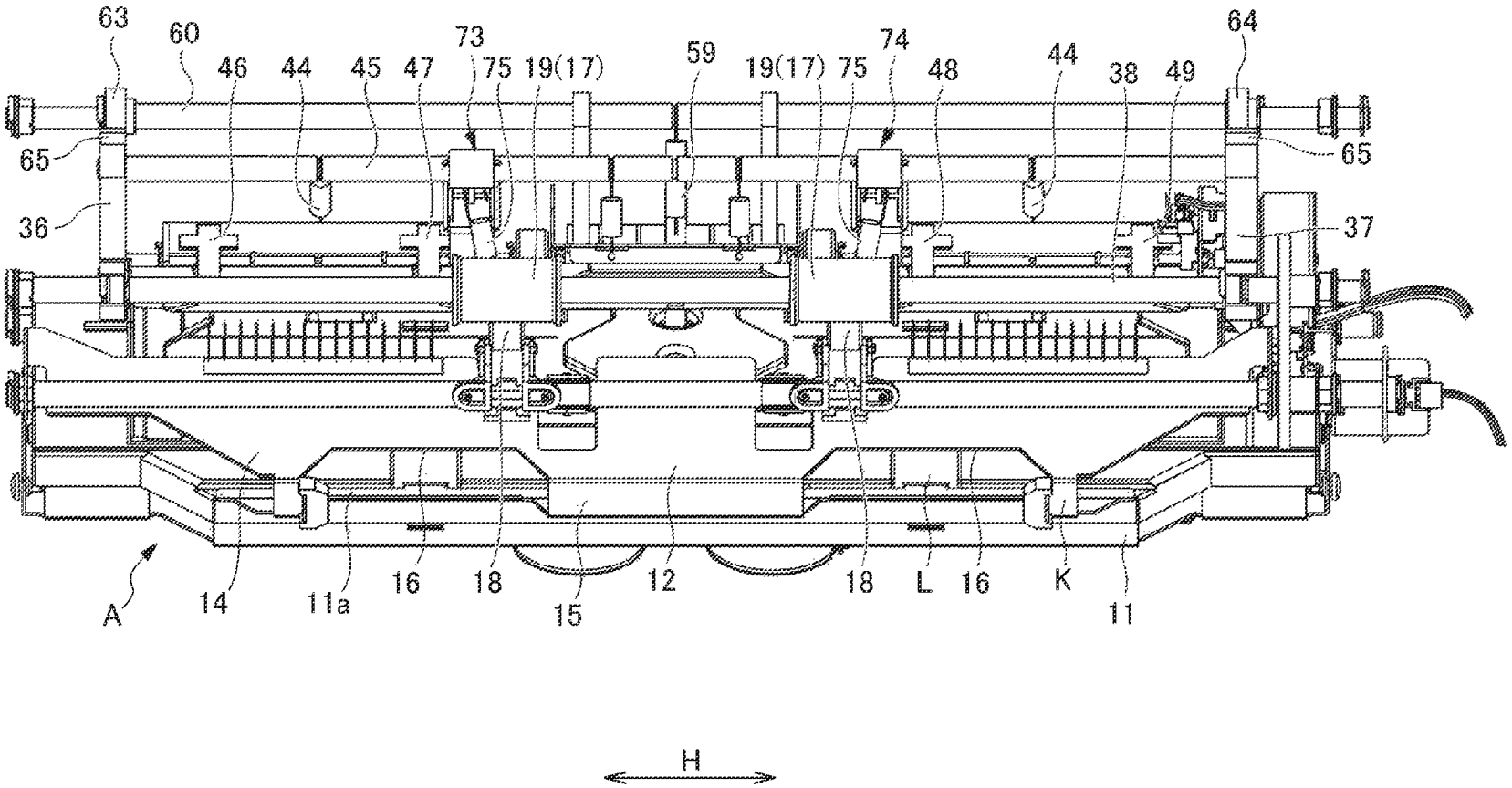
FIG. 12 is a view illustrating specific configurations of the paper-sheet supporting unit and the paper-sheet aligning unit in the second embodiment, and is a front view (corresponding to FIG. 3) seen from the direction of feeding a sheet of paper.
Figure 13:
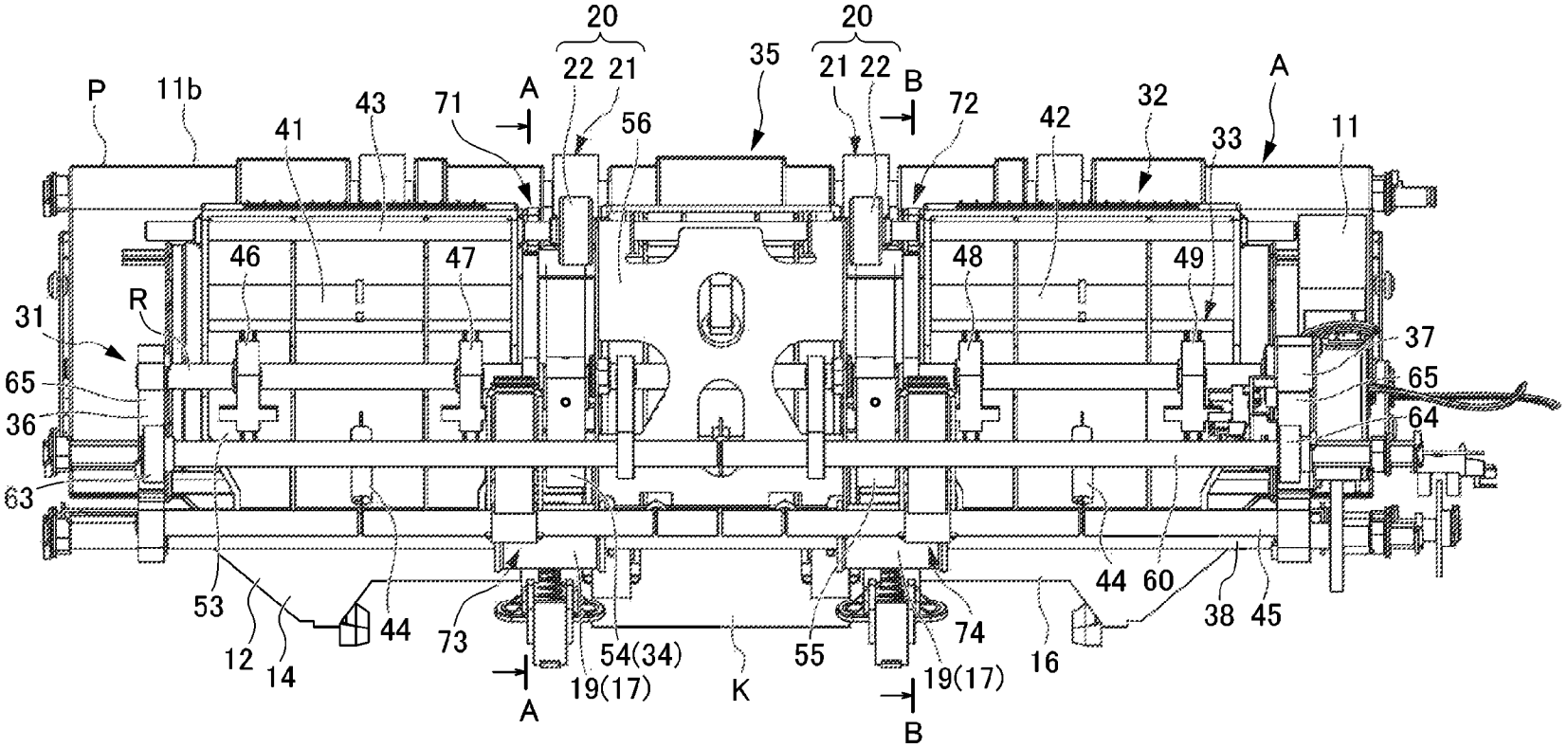
FIG. 13 is a plan view (corresponding to FIG. 4) illustrating specific configurations of the paper-sheet supporting unit and the paper-sheet aligning unit of the second embodiment.
Figure 14:
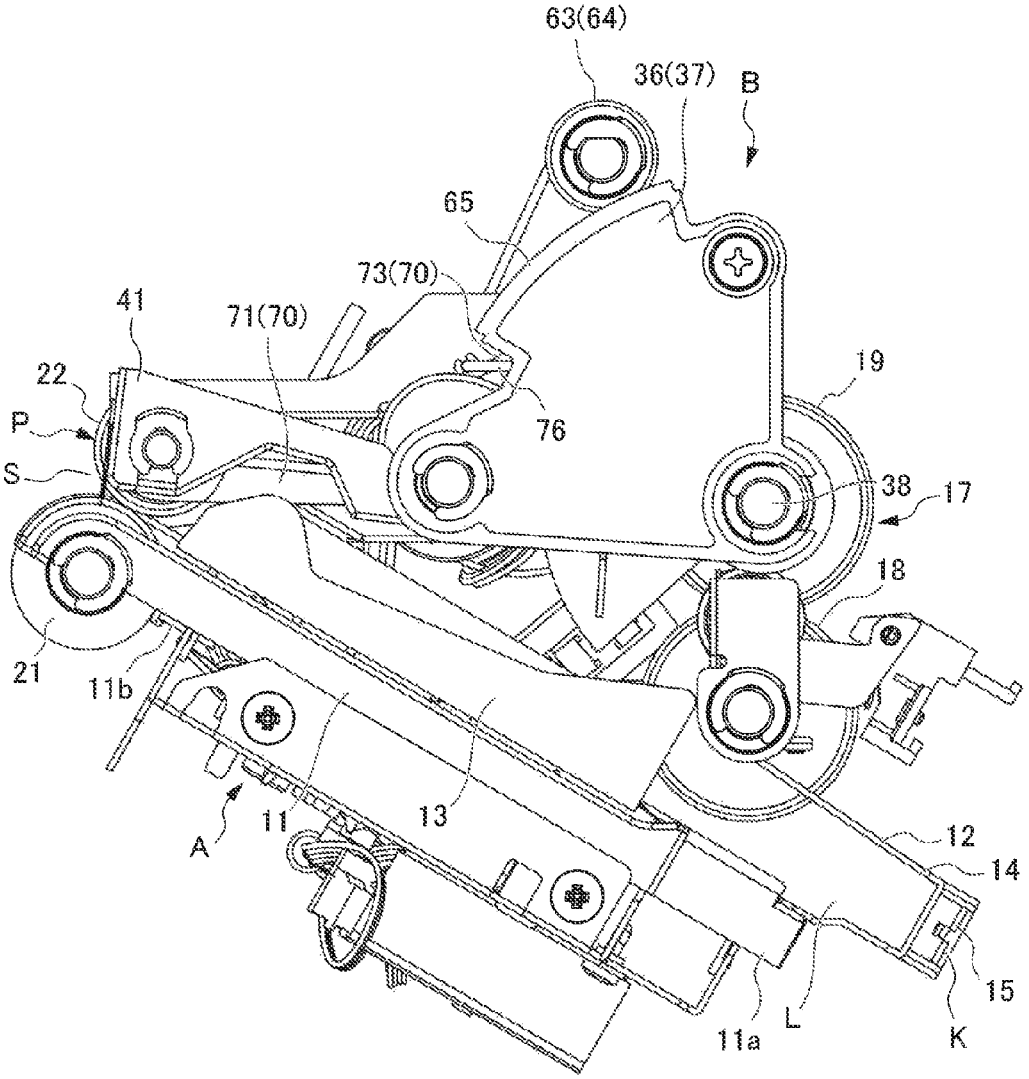
FIG. 14 is a side view (corresponding to FIG. 5) illustrating specific configurations of the paper-sheet supporting unit and the paper-sheet aligning unit in FIG. 1.
Figure 15A:
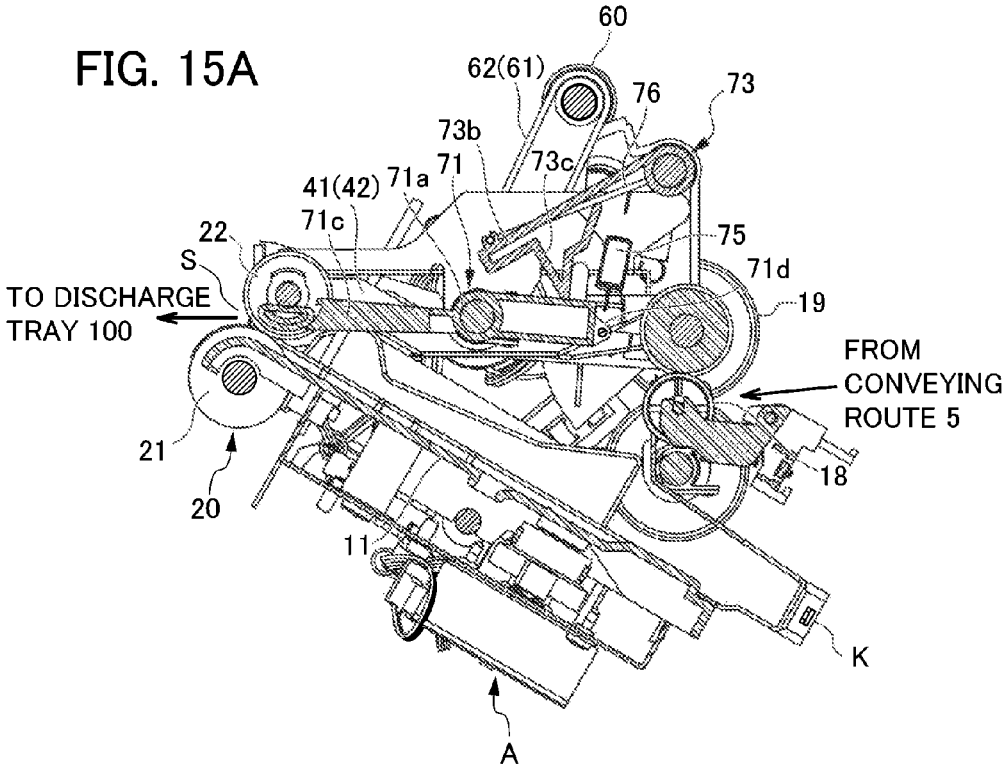
FIG. 15A is a cross-sectional view (corresponding to FIG. 8A) taken along line A-A in FIG. 13.
Figure 15B:
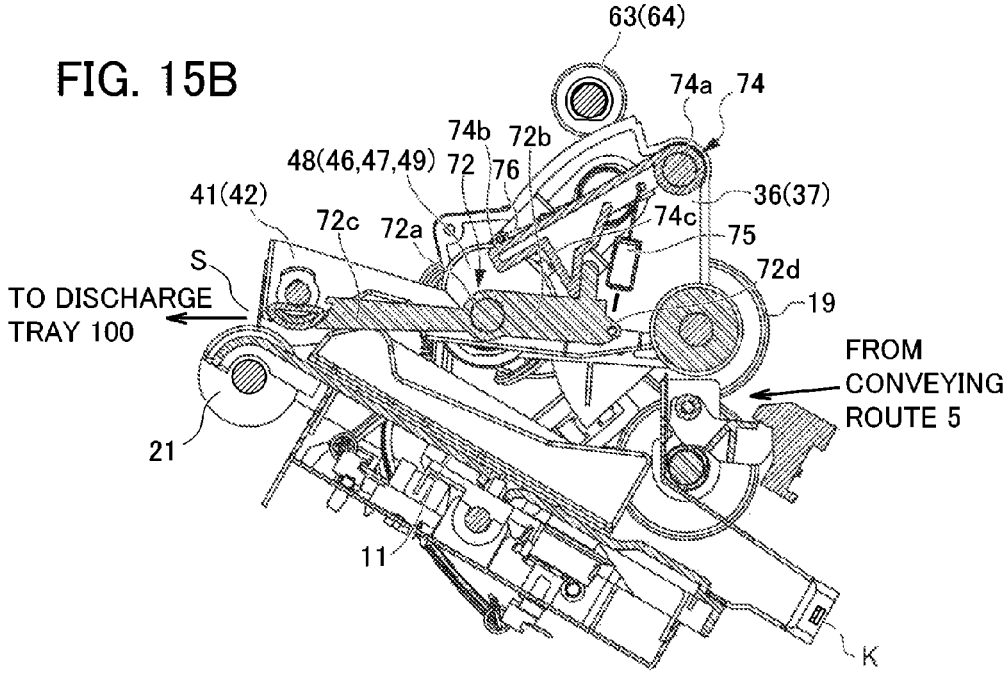
FIG. 15B is a cross-sectional view (corresponding to FIG. 8B) taken along line B-B in FIG. 13.
Figure 16:
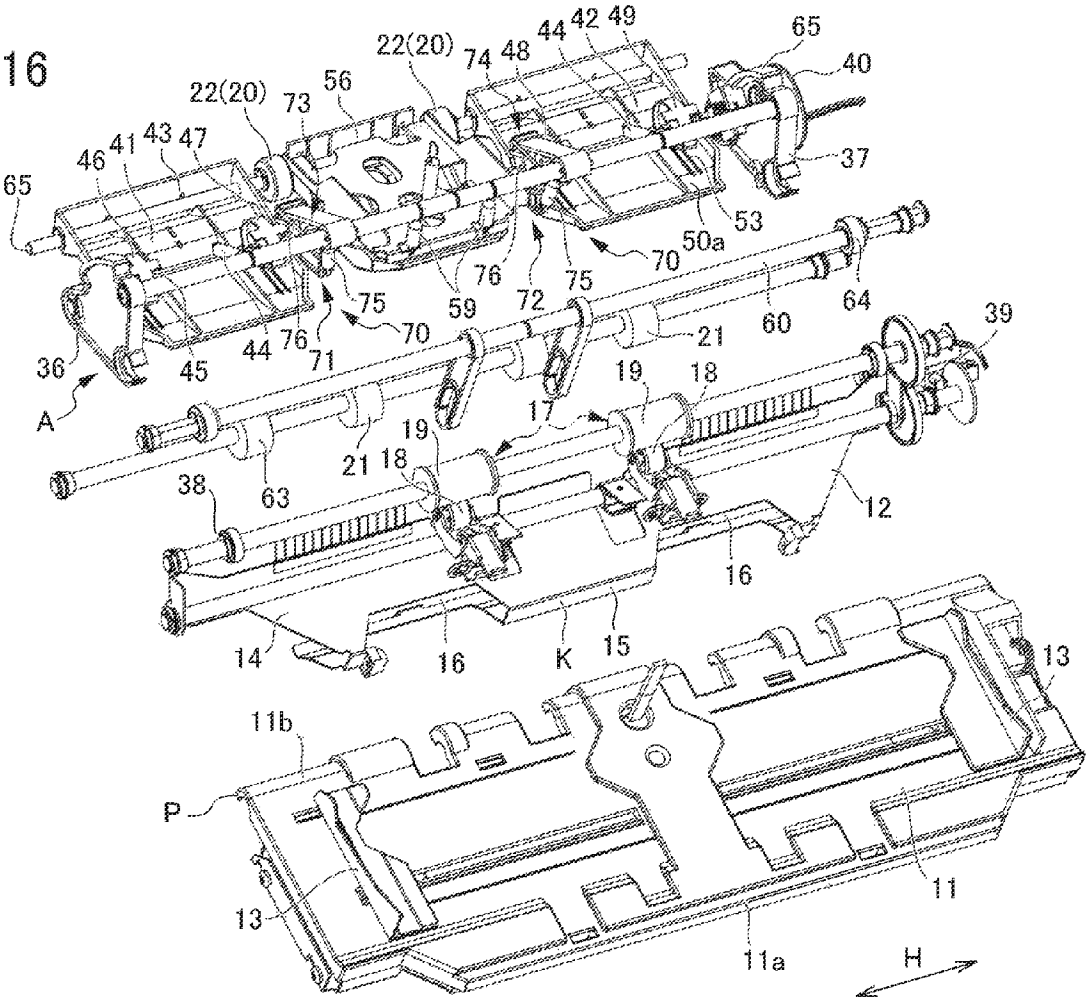
FIG. 16 is an exploded perspective view (corresponding to FIG. 6) illustrating specific configurations of the paper-sheet supporting unit and the paper-sheet aligning unit of the second embodiment.
Figure 17:
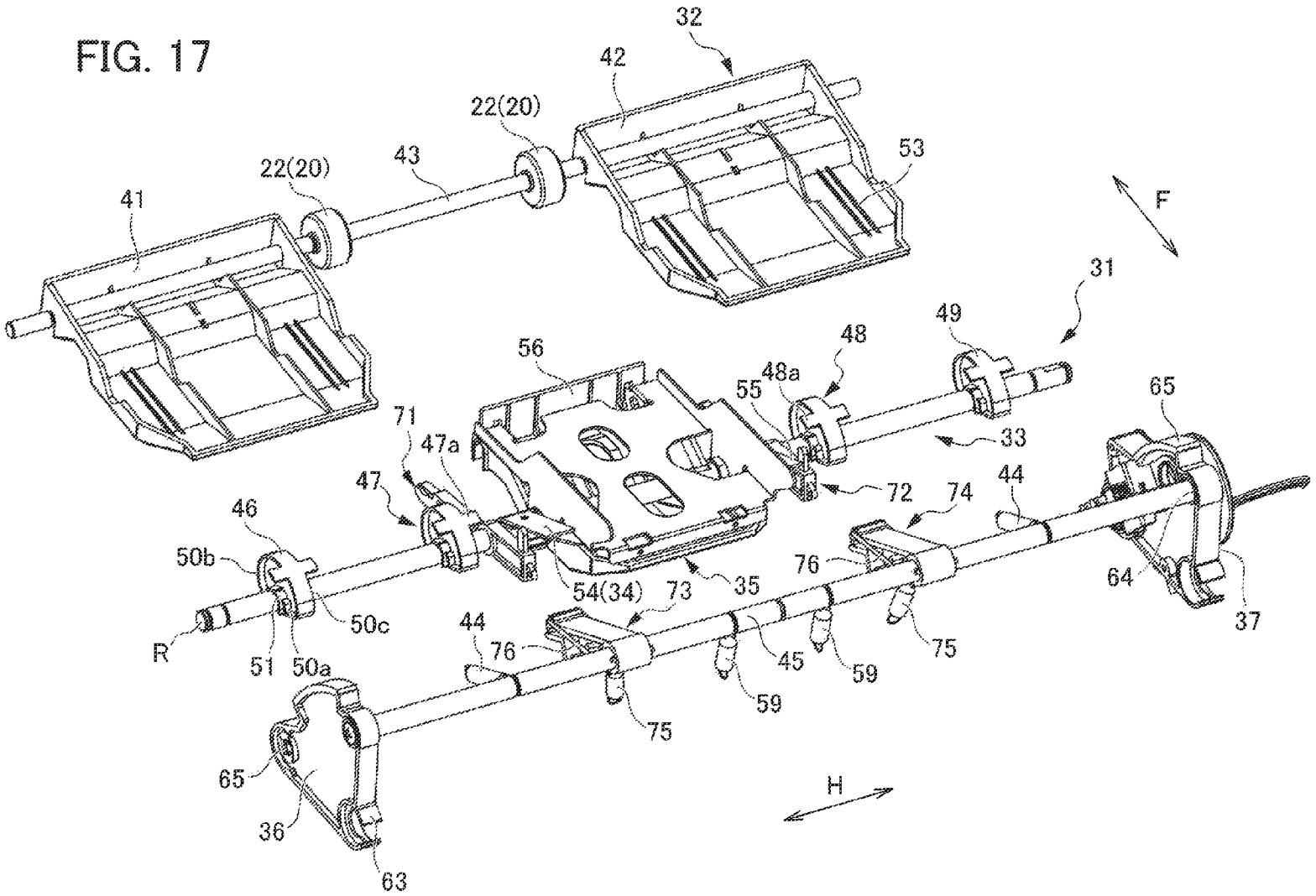
FIG. 17 is an exploded perspective view (corresponding to FIG. 7A) illustrating specific configurations of the paper-sheet aligning unit of the second embodiment.
Figure 18:
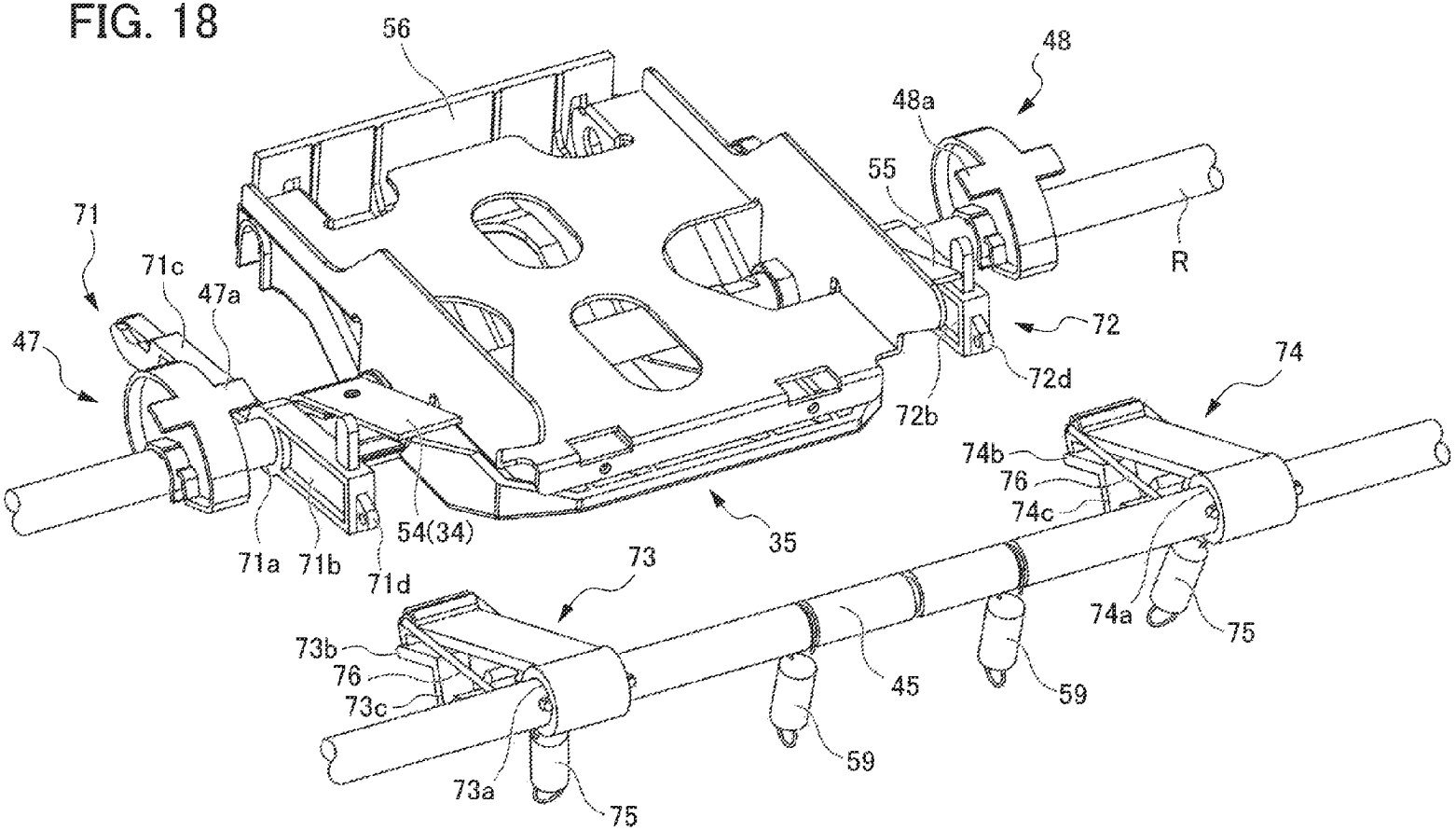
FIG. 18 is a partially enlarged view of FIG. 17.

FIG. 11 is a view illustrating specific configurations of a paper-sheet supporting unit and a paper-sheet aligning unit in the second embodiment, and is a perspective view (corresponding to FIG. 2) seen from a direction of feeding a sheet of paper. FIG. 12 is a view illustrating the specific configurations of the paper-sheet supporting unit and paper-sheet aligning unit in the second embodiment, and is a front view (corresponding to FIG. 3) seen from the direction of feeding a sheet of paper. FIG. 13 is a plan view (corresponding to FIG. 4) illustrating the specific configurations of the paper-sheet supporting unit and paper-sheet aligning unit in the second embodiment. FIG. 14 is a side view (corresponding to FIG. 5) illustrating the specific configurations of the paper-sheet supporting unit and paper-sheet aligning unit in FIG. 1. FIG. 15A is a cross-sectional view (corresponding to FIG. 8A) taken along line A-A in FIG. 13. FIG. 15B is a cross-sectional view (corresponding to FIG. 8B) taken along line B-B in FIG. 13. FIG. 16 is an exploded perspective view (corresponding to FIG. 6) illustrating the specific configurations of the paper-sheet supporting unit and paper-sheet aligning unit in the second embodiment. FIG. 17 is an exploded perspective view (corresponding to FIG. 7A) illustrating the specific configurations of the paper-sheet aligning unit in the second embodiment. FIG. 18 is a partially enlarged view of FIG. 17.

Figure 19:
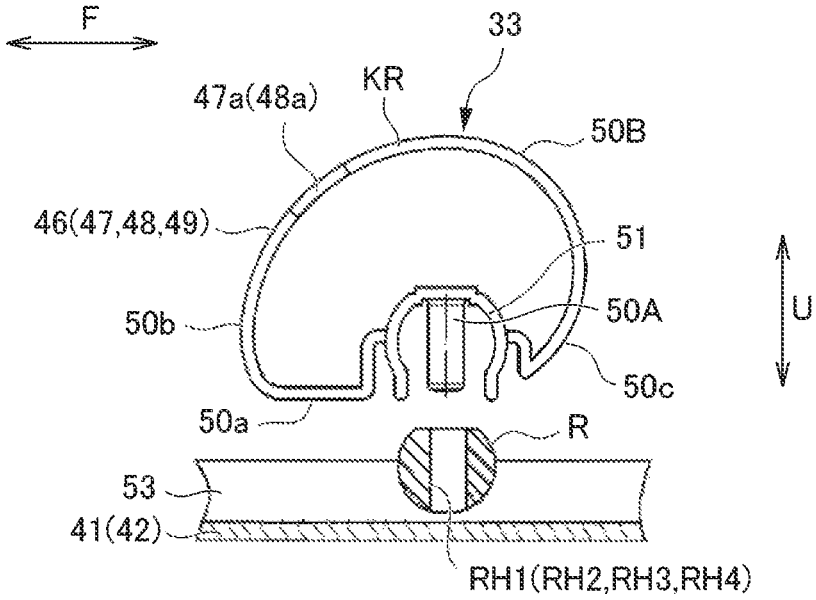
FIG. 19 is an exploded side view (corresponding to FIG. 7B) of a cam mechanism of the second embodiment.
Figure 20A:
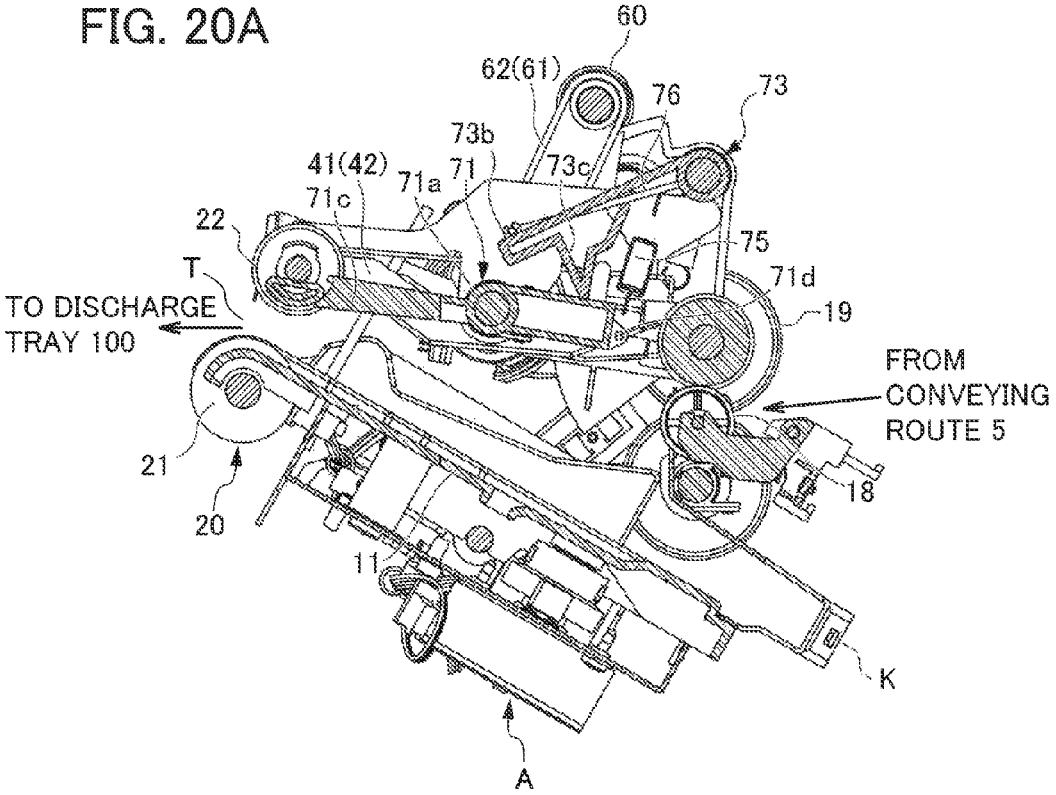
FIG. 20A is a cross-sectional view illustrating a state where nipping by a pair of first discharge rollers is released and a paper-sheet stopping member 71 is arranged in a non-stop position in a paper-sheet post-processing device according to the second embodiment, and corresponds to FIG. 15A.
Figure 20B:
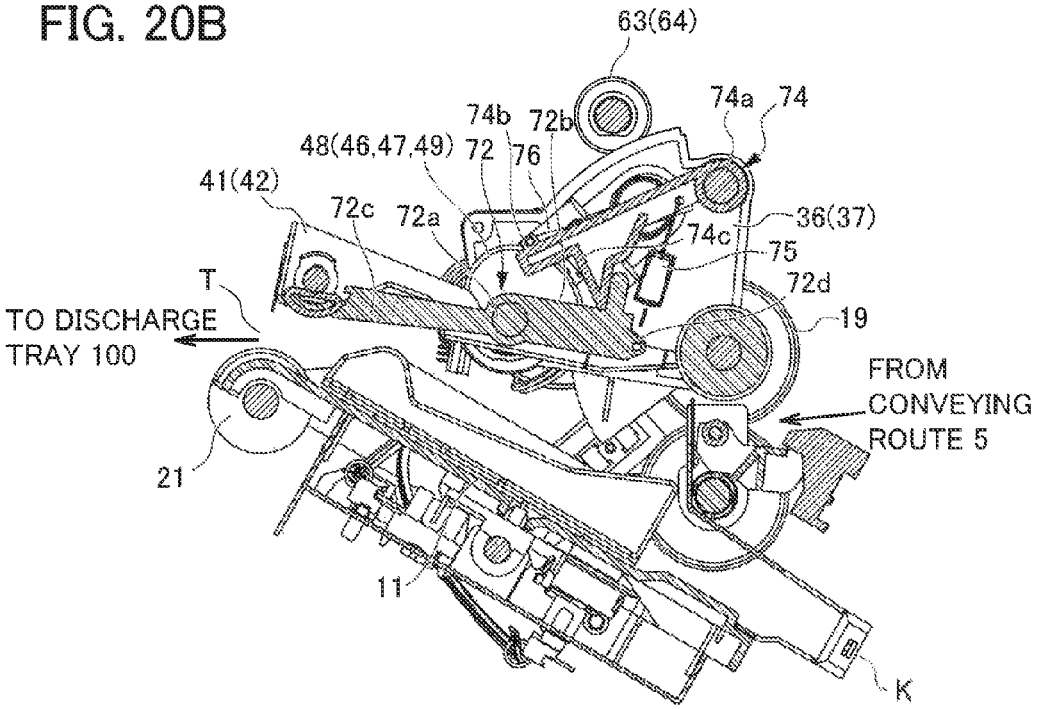
FIG. 20B is a cross-sectional view illustrating a state where nipping by the pair of first discharge rollers is released and the paper-sheet stopping member 71 is arranged in the non-stop position in the paper-sheet post-processing device according to the second embodiment, and corresponds to FIG. 15B.
Figure 21A:
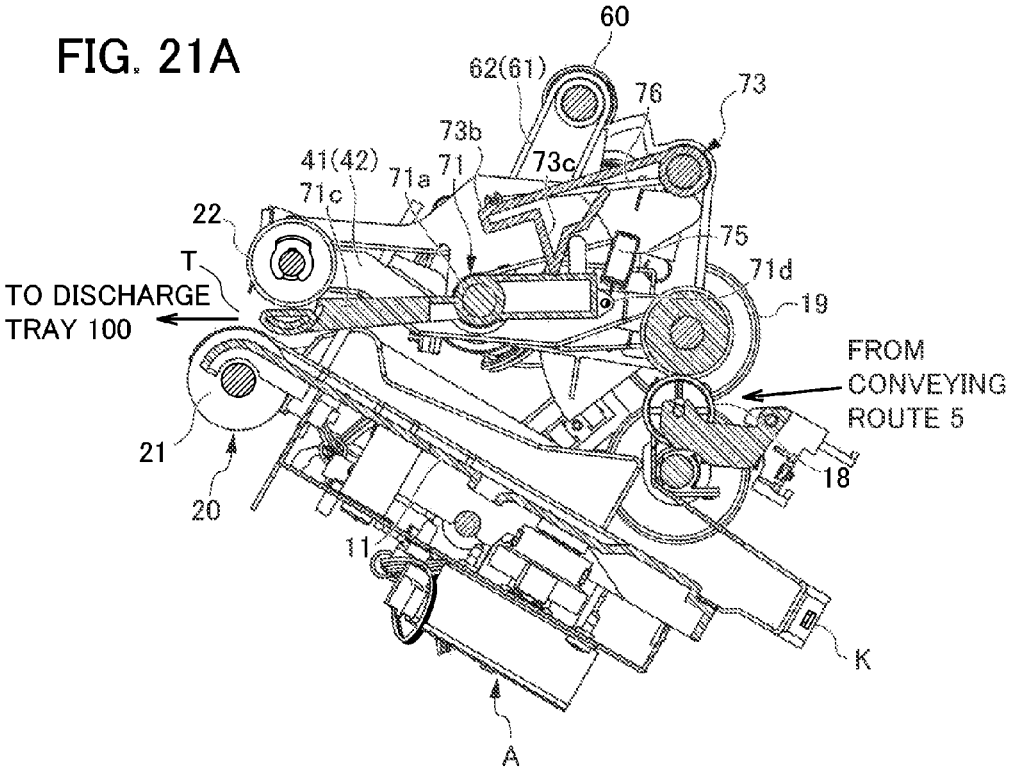
FIG. 21A is a cross-sectional view illustrating a state where nipping by the pair of first discharge rollers is released and the paper-sheet stopping member 71 is arranged in the stop position in the paper-sheet post-processing device according to the second embodiment, and corresponds to FIG. 15A.
Figure 21B:
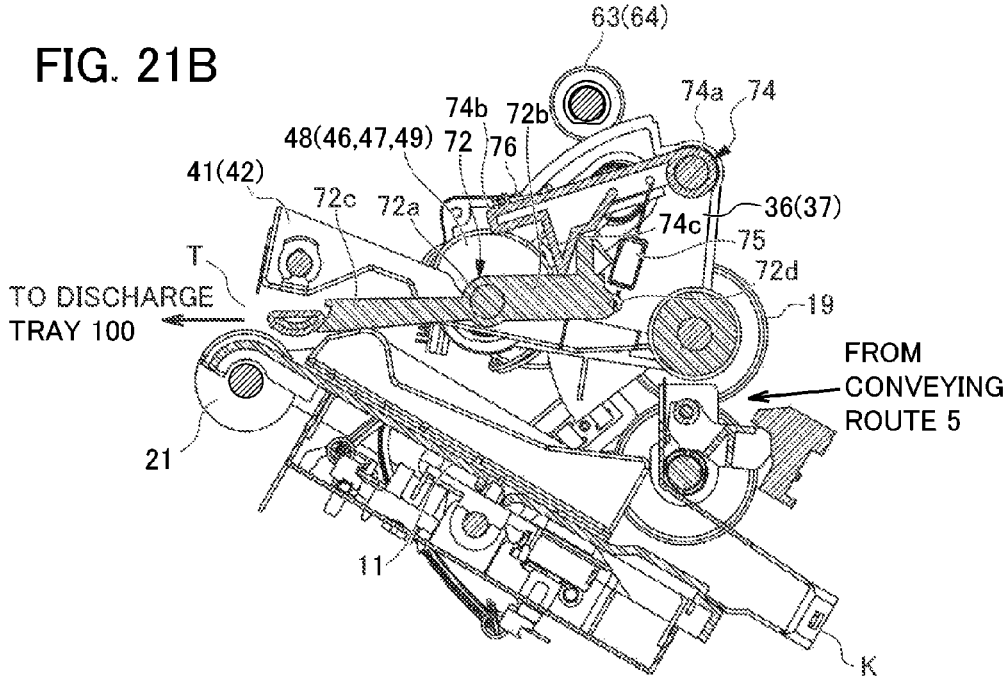
FIG. 21B is a cross-sectional view illustrating a state where nipping by the pair of first discharge rollers is released and the paper-sheet stopping member 71 is arranged in the stop position in the paper-sheet post-processing device according to the second embodiment, and corresponds to FIG. 15B.

FIG. 19 is an exploded side view (corresponding to FIG. 7B) of a cam mechanism in the second embodiment. FIG. 20A is a cross-sectional view illustrating a state where nipping by a pair of first discharge rollers is released and a paper-sheet stopping member 71 is arranged in a non-stop position in the paper-sheet post-processing device according to the second embodiment, and corresponds to FIG. 15A. FIG. 20B is a cross-sectional view illustrating a state where nipping by the pair of first discharge rollers is released and the paper-sheet stopping member 71 is arranged in the non-stop position in the paper-sheet post-processing device according to the second embodiment, and corresponds to FIG. 15B. FIG. 21A is a cross-sectional view illustrating a state where nipping by the pair of first discharge rollers is released and the paper-sheet stopping member 71 is arranged in a stop position in the paper-sheet post-processing device according to the second embodiment, and corresponds to FIG. 15A. FIG. 21B is a cross-sectional view illustrating a state where nipping by the pair of first discharge rollers is released and the paper-sheet stopping member 71 is arranged in the stop position in the paper-sheet post-processing device according to the second embodiment, and corresponds to FIG. 15B.

The second embodiment mainly differs from the first embodiment in that a paper-sheet aligning unit C further has a paper-sheet stopping mechanism 70. Hence, with the second embodiment, the paper-sheet stopping mechanism 70 will be mainly described, and description of other components will be omitted or simplified.

As illustrated in FIGS. 11 to 13, the paper-sheet stopping mechanism 70 stops the sheets of paper fed from a conveying route 5 to a paper-sheet supporting unit A. A pair of paper-sheet stopping mechanisms 70 is provided spaced each other in a paper-sheet width direction H. As illustrated in FIGS. 14 to 19, a paper-sheet stopping mechanism 70 on a side closer to a cam member 47 has a paper-sheet stopping member 71, a pressing member 73, a coil spring 75 and a torsion spring 76. A paper-sheet stopping mechanism 70 on a side closer to a cam member 48 has a paper-sheet stopping member 72, a pressing member 74, a coil spring 75 and a torsion spring 76.

The paper-sheet stopping members 71 and 72 are arranged swingable about a rotation shaft R such that the paper-sheet stopping members 71 and 72 are movable to a stop position and a non-stop position. The stop position is where sheets of paper are stopped (see FIGS. 21A and 21B) and the non-stop position is where sheets of paper are not stopped (see FIGS. 20A and 20B).

As illustrated in FIGS. 15A, 15B, 20A, 20B, 21A and 21B, the pressing members 73 and 74 press the paper-sheet stopping members 71 and 72, respectively, and cause the paper-sheet stopping members 71 and 72 to swing about the rotation shaft R.

The paper-sheet stopping members 71 and 72 will be described in detail.

As illustrated in FIGS. 15A, 15B and 18, the paper-sheet stopping member 71 has an elongated shape when viewed overall, and is arranged between the cam member 47 and an aligning member 54 in the paper-sheet width direction H. The paper-sheet stopping member 72 is arranged between the cam member 48 and an aligning member 55 in the paper-sheet width direction H.

Since the paper-sheet stopping members 71 and 72 are similarly configured each other, the paper-sheet stopping member 71 will be described. Description of the paper-sheet stopping member 71 is adequately employed for the paper-sheet stopping member 72 by replacing the reference numeral "71" with "72".

As illustrated in FIGS. 15A, 15B and 18, the paper-sheet stopping member 71 has a fulcrum 71*a*, an effort part 71*b*, an application part 71*c* and a spring linking part 71*d*.

The fulcrum 71*a* is positioned in the center part of the paper-sheet stopping member 71 in a longitudinal direction, and is formed with a hole in which the rotation shaft R is inserted. As the rotation shaft R is inserted in the fulcrum 71*a*, the paper-sheet stopping member 71 is arranged swingably on the rotation shaft R.

The effort part 71*b* is a part closer to a support shaft 45 than the fulcrum 71*a* in the paper-sheet stopping member 71.

The spring linking part 71*d* is provided at a front end part of the effort part 71*b*. One end part of the coil spring 75 is linked to the effort part 71*b* through the spring joining part 71*d*. The coil spring 75 links the spring linking part 71*d* at the front end part of the effort part 71*b* and the support shaft 45 through the pressing member 73. Accordingly, the coil spring 75 exercises an upward biasing force in the direction in which the front end part of the effort part 71*b* comes closer to the support shaft 45.

The application part 71*c* is a part closer to the swing shaft 43 than the fulcrum 71*a* in the paper-sheet stopping member 71. As illustrated in FIGS. 21A and 21B, a lower surface of the application part 71*c* presses an upper surface of a paper-sheet supporting unit A on a side closer to a rear end 11*b* of a processing tray 11, so that the application part 71*c* can stop sheets of paper fed in the paper-sheet supporting unit A from a conveying route 5.

Next, the pressing members 73 and 74 will be described in detail.

As illustrated in FIGS. 15A, 15B and 18, the pressing members 73 and 74 each have an elongated shape when viewed overall, and are arranged swingably on the support shaft 45. The pressing member 73 is arranged above the paper-sheet stopping member 71. The pressing member 74 is arranged above the paper-sheet stopping member 72.

Since the pressing members 73 and 74 are similarly configured each other, the pressing member 73 will be described. Description of the pressing member 73 is adequately employed for the pressing member 74 by replacing the reference numeral "73" with "74".

As illustrated in FIGS. 15A, 15B and 18, the pressing member 73 has a fulcrum 73*a*, an effort part 73*b*, an application part 73*c* and a spring linking part 73*d*.

The fulcrum 73*a* is positioned at one end part of the pressing member 73 in a longitudinal direction, and is formed with a hole in which the support shaft 45 is inserted. When the rotation shaft R is inserted in the fulcrum 73*a*, the pressing member 73 is arranged swingably on the support shaft 45.

The effort part 73*b* is positioned in the other end part of the pressing member 73 in the longitudinal direction. The effort part 73*b* is biased downward in a direction to come closer to the paper-sheet stopping part 71 by a biasing force exerted by the torsion spring 76 (described later).

The application part 73*c* lies between the fulcrum 73*a* and effort part 73*b*. The application part 73*c* projects downward toward an upper surface of the effort part 71*b* of the paper-sheet stopping member 71. As illustrated in FIGS. 20A and 20B, when the application part 73*c* presses the upper surface of the effort part 71*b* of the paper-sheet stopping member 71, the paper-sheet stopping member 71 swings about the fulcrum 71*a*. In this manner, it is possible to cause the lower surface of the application part 71*c* to move upward in a direction to depart away from an upper surface of the processing tray 11 of the paper-sheet supporting unit A.

The spring linking part 73*d* is provided on an upper part of the effort part 73*b*. One end part of the torsion spring 76 is linked to the spring linking part 73*d*. The torsion spring 76 is also linked to the support shaft 45. That is, the torsion spring 76 links the spring linking part 73*d* (effort part 73*b*) of the pressing member 73 and the support shaft 45. Accordingly, the torsion spring 76 exercises a downward biasing force in a direction in which the application part 73*c* of the pressing member 73 comes closer to the paper-sheet stopping member 71.

The paper-sheet stopping member 71 and pressing member 73 employing the above-described configuration operate as follows.

Description is provided for a case when the application part 73*c* of the pressing member 73 does not press the effort part 71*b* of the paper-sheet stopping member 71 or the pressing force is relatively small, as illustrated in FIGS. 21A and 21B. The paper-sheet stopping member 71 swings such that the effort part 71*b* of the paper-sheet stopping member 71 is positioned upward and the application part 71*c* of the paper-sheet stopping member 71 is positioned downward. Simultaneously, the lower surface of the application part 71*c* abuts the upper surface of the processing tray 11 of the paper-sheet supporting unit A. The paper-sheet stopping member 71 is at a "stop position" where sheets of paper are stopped.

By contrast with this, when the application part 73*c* of the pressing member 73 sufficiently presses the effort part 71*b* of the paper-sheet stopping member 71, as illustrated in FIGS. 20A and 20B, the paper-sheet stopping member 71 swings such that the effort part 71*b* of the paper-sheet stopping member 71 is positioned downward and the application part 71*c* of the paper-sheet stopping member 71 is positioned upward. Simultaneously, the lower surface of the application part 71*c* separates from the upper surface of the processing tray 11 of the paper-sheet supporting unit A. The paper-sheet stopping member 71 is in a "non-stop position" where sheets of paper are not stopped.

That is, when the pressing member 73 undergoes operation to swing, the paper-sheet stopping member 71 swings accordingly. In this manner, the paper-sheet aligning unit C causes the paper-sheet stopping member 71 to move to the stop position (see FIGS. 21A and 21B) and the non-stop position (see FIGS. 20A and 20B).

The operation of swinging the pressing member 73 is performed by the cam member 47. In addition, the operation of swinging the pressing member 74 is performed by the cam member 48.

Next, an operation of swinging the pressing member 73 by the cam member 47 will be described. Since the cam members 47 and 48 are similarly configured each other, the cam member 47 will be described. Description of the cam member 47 will be adequately employed for the cam member 48 by replacing reference numeral "47" with "48".

As illustrated in FIGS. 15B, 18 and 19, the cam member 47 has an operation part 47*a* projecting toward the center of the paper-sheet width direction H (toward the pressing member 73). As illustrated in FIG. 19, the operation part 47*a* is integrally formed with a first curved outer peripheral shape 50*b* of a cam shape KR. The operation part 47*a* operates the pressing member 73 accompanying rotation of the cam member 47.

Since features other than the operation part 47*a* are the same as the cam member 47 in the first embodiment, description thereof will be omitted.

As illustrated in FIGS. 21A and 21B, when the operation part 47*a* is positioned upward accompanying rotation of the cam member 47, the operation part 47*a* presses the other end part of the pressing member 73 upward on an upper surface of the operation part 47*a*. When the other end part of the pressing member 73 is pressed upward by the operation part 47*a*, the pressing member 73 swings about the fulcrum 73*a* in a direction to release pressing of the paper-sheet stopping member 71 performed by the application part 73*c*. In this manner, the effort part 71*b* of the paper-sheet stopping member 71 is biased by the coil spring 75 and moves upward. As a result, the paper-sheet stopping member 71 swings about the fulcrum 71*a*, and the application part 71*c* moves downward. Then, the paper-sheet stopping member 71 is arranged in the stop position.

By contrast with this, as illustrated in FIGS. 20A and 20B, when the operation part 47*a* of the cam member 47 does not press the other end part of the pressing member 73 upward, the application part 73*c* of the pressing member 73 presses the effort part 71*b* of the paper-sheet stopping member 71. Accordingly, the application part 71*c* of the paper-sheet stopping member 71 is positioned upward, and the paper-sheet stopping member 71 is arranged in the non-stop position.

Staple Processing Operation

Next, a staple processing operation of the paper-sheet post-processing device 1 according to the second embodiment will be described with reference to FIGS. 11 to 21B.

For ease of description, as illustrated in FIGS. 15A and 15B, second discharge rollers 22 are in a position to pressure first discharge rollers 21 (hereinafter referred to as "pressured position S"). As illustrated in FIGS. 15A and 15B, paper-sheet holding guides 41 and 42 and aligning members 54 and 55 are in a position retreated in the paper-sheet aligning unit C (hereinafter referred to as "initial state").

A control device 300 receives a staple processing signal through an input operation by an operator (user). Further, as illustrated in FIGS. 15A, 15B, 20A and 20B, the control device 300 drives a discharge driving motor (not illustrated) to cause a transmission shaft 60 to reversely rotate (in the counterclockwise direction).

In this manner, as illustrated in FIGS. 15A, 15B, 20A and 20B, gear parts 65 mesh with gears 63 and 64, so that support parts 36 and 37 swing (rotate) to separate from the processing tray 11. Accompanying this, the discharging unit 35 also swings (rotates) such that the second discharge rollers 22 are separated from the first discharge rollers 21.

In this manner, the second discharge rollers 22 of the discharging unit 35 are separated from the first discharge rollers 21, and move from the pressured position S illustrated in FIGS. 15A and 15B to a separated position T illustrated in FIGS. 20A and 20B, thereby releasing pressuring (releasing nipping).

The control device 300 drives an alignment driving motor 40 illustrated in FIGS. 11 and 16 to cause a pair of feed rollers 17 to rotate. At the same time, as illustrated in FIG. 13, the control device 300 causes the alignment driving motor 40 to drive the rotation shaft R to rotate.

Sheets of paper conveyed from a image forming device Z are fed to the paper-sheet supporting unit A by a pair of conveying rollers 6 and the pair of feed rollers 17 while being guided on the conveying route 5.

Further, as illustrated in FIGS. 20A, 20B, 21A and 21B, when the rotation shaft R rotates, cam members 46 to 49 and the aligning members 54 and 55 also rotate in the counterclockwise direction.

As illustrated in FIGS. 21A and 21B, when the operation part 47*a* moves upward accompanying rotation of the cam member 47, the operation part 47*a* presses the other end part of the pressing member 73 upward on the upper surface of the operation part 47*a*. When the other end part of the pressing member 73 is pressed upward by the operation part 47*a*, the pressing member 73 swings about the fulcrum 73*a* in the direction to release pressing of the paper-sheet stopping member 71 performed by the application part 73*c*. Accordingly, the effort part 71*b* of the paper-sheet stopping member 71 is biased by the coil spring 75 and moves upward. As a result, the paper-sheet stopping member 71 swings about the fulcrum 71*a*, and the application part 71*c* moves downward. Then, the paper-sheet stopping member 71 is arranged in the stop position.

The paper-sheet stopping member 71 is arranged to the stop position synchronously when the sheets of paper are fed in the paper-sheet supporting unit A. Therefore, the sheets of paper fed in the paper-sheet supporting unit A are temporarily stopped by the paper-sheet stopping member 71.

As illustrated in FIGS. 20A and 20B, when the cam member 47 further rotates, the operation part 47*a* of the cam member 47 separates from the pressing member 73 and stops pressing the pressing member 73. In this manner, the application part 73*c* of the pressing member 73 resumes pressing the effort part 71*b* of the paper-sheet stopping member 71 downward. As a result, the application part 71*c* of the paper-sheet stopping member 71 is positioned upward, and the paper-sheet stopping member 71 is arranged in the non-stop position.

As described above, the paper-sheet stopping member 71 is arranged in the non-stop position (see FIGS. 20A and 20B), followed by further rotation of the cam member 47.

The operations (operations of stopping sheets of paper) of the paper-sheet stopping member 71 and pressing member 73 accompanying rotation of the above-described cam member 47 are performed likewise in the cam member 48. That is, the cam member 48 causes the paper-sheet stopping member 72 and pressing member 74 to perform the operations (operations of stopping sheets of paper) of.

As illustrated in FIGS. 15A and 15B, when the cam members 46 and 47 rotate, the paper-sheet holding guides 41 and 42 move from the initial state towards the processing tray 11 while resisting the spring forces exerted by coil springs 44.

With each of the cam members 46 to 49, a straight outer peripheral shape 50*a* illustrated in FIG. 19 abuts each of the paper-sheet holding guides 41 and 42. When the cam members 46 to 49 further rotate from this state and a second curved outer peripheral shape 50*c* abuts each of the paper-sheet holding guides 41 and 42, the paper-sheet holding guides 41 and 42 come closer toward a standard position K using the swing shaft 43 as a support point.

As illustrated in FIGS. 15A and 15B, the paper-sheet holding guides 41 and 42 swing at predetermined timing after the rear end of a sheet of paper passes the pair of feed rollers 17 (feed rollers 18 and 19).

When each of the cam members 46 to 49 rotates, the second curved outer peripheral shape 50*c* abuts each of the paper-sheet holding guides 41 and 42. As each of the cam members 46 to 49 further rotates subsequently, the first curved outer peripheral shape 50*b* comes to abut each of the paper-sheet holding guides 41 and 42, accordingly. In this manner, the paper-sheet holding guides 41 and 42 each swing to come closer to the processing tray 11.

According to a series of the cam operations described above, the paper-sheet holding guides 41 and 42 tap down the sheets of paper fed from the conveying route 5 through the pair of feed rollers 17 onto the processing tray 11.

The sheets of paper tapped down by the paper-sheet holding guides 41 and 42 are supported on the processing tray 11. At this time, a part of the sheets of paper reaches a discharge tray 100 from a pair of first discharge rollers 20. That is, the processing tray 11 supports another part of the sheets of paper.

By contrast with this, the aligning members 54 and 55 abut a sheet of paper from a side closer to a discharge position P of the processing tray 11 and press the sheet of paper at timing when the sheet of paper fed from the conveying route 5 is supported on the processing tray 11. When the aligning members 54 and 55 are further rotates under the condition described above, the sheet of paper supported on the processing tray 11 moves up to the standard position K of the processing tray 11 by rotation of the aligning members 54 and 55, and abut a front cover plate 15 to be aligned.

Further, when a plurality of sheets of paper is supported on the processing tray 11 and aligned by repeating the above processing steps, a binding mechanism (not illustrated) of a staple unit B is inserted in staple inserting ports 16 to execute single binding and multiple binding (staple processing) of the plurality of sheets of paper.

As illustrated in FIGS. 15A, 15B, 20A and 20B, when staple processing is finished, the control device 300 drives the discharge driving motor (not illustrated) to cause the transmission shaft 60 to normally rotate (in a clockwise direction).

In this manner, as illustrated in FIGS. 15A, 15B, 20A and 20B, the gear parts 65 mesh with the gears 63 and 64, so that the support parts 36 and 37 swing (rotate) to come closer to the processing tray 11. Following this, the discharging unit 35 also swings (rotates) such that the second discharge rollers 22 come closer to the first discharge rollers 21.

Accordingly, the second discharge rollers 22 of the discharging unit 35 come closer to the first discharge rollers 21 and move from the separated position T illustrated in FIGS. 20A and 20B to the pressured position S illustrated in FIGS. 15A and 15B. In this manner, the sheets of paper to which staple processing has been applied are pressed (nipped) between the second discharge rollers 22 and first discharge rollers 21.

Further, when the first discharge rollers 21 are driven to rotate, the sheets of paper to which staple processing has been applied are discharged to the discharge tray 100.

According to the second embodiment, for example, the following effect is provided.

According to the second embodiment, it is possible to easily stop a sheet of paper by swinging the paper-sheet stopping members 71 and 72. In addition, according to the second embodiment, it is possible to easily changeover between stopping and non-stopping of a sheet of paper by swinging the paper-sheet stopping members 71 and 72.

According to Second embodiment, it is possible to operate the pressing members 73 and 74 by rotating the cam members 46 to 49, and swing the paper-sheet stopping members 71 and 72. That is, according to the second embodiment, it is possible to changeover between stopping and non-stopping of a sheet of paper in conjunction with rotation of the rotation shaft R.

In addition, according to the second embodiment, a mechanical setup (rotation of the cam members 46 to 49) realizes adjustment among: timing for stopping a sheet of paper performed by the paper-sheet stopping members 71 and 72, timing for holding the sheet of paper performed by the paper-sheet holding part 32 and timing for aligning the sheet of paper with the standard position K performed by the aligning members 54 and 55. Accordingly, it is possible to stably execute an operation of aligning the sheet of paper.

What is claimed is:

1. A paper-sheet post-processing device comprising:

a paper-sheet supporting unit, which is arranged on a conveying route guiding a sheet of paper conveyed from an image forming device, configured to support the sheet of paper fed from the conveying route;

a staple unit, which is arranged at a standard position of the paper-sheet supporting unit, configured to execute binding processing of the sheet of paper supported by the paper-sheet supporting unit; and a paper-sheet aligning unit configured to align the sheet of paper supported by the paper-sheet supporting unit with the standard position;

wherein the paper-sheet aligning unit comprises:

a main unit, which is disposed opposite to the paper-sheet supporting unit, comprising a first support part and a second support part that are arranged straddling the conveying route;

a paper-sheet holding part, which is arranged on the main unit, configured to hold the sheet of paper supported by the paper-sheet supporting unit;

a cam mechanism, which comprises a cam member rotatably arranged on the main unit, configured to place the paper-sheet holding part close to and at a distance from the paper-sheet supporting unit by rotation of the cam member, an aligning mechanism, which comprises an aligning member rotatably arranged on the main unit, configured to align the sheet of paper supported by the paper-sheet supporting unit with the standard position by rotation of the aligning member; and a paper-sheet stopping comprising a paper-sheet stopping member configured to stop the sheet of paper fed from the conveying route to the paper-sheet supporting unit, wherein the main unit comprises a rotation shaft which is rotatably supported axially by the first support part and the second support part wherein the cam member and the aligning member are arranged to be fixed to the rotation shaft, and wherein the paper-sheet stopping member is arranged swingable on the rotation shaft such that the paper-sheet stopping member is movable to a stop position where the sheet of paper is stopped and a non-stop position where the sheet of paper is not stopped.

2. The paper-sheet post-processing device according to claim 1, wherein the paper-sheet stopping mechanism comprises a pressing member configured to press the paper-sheet stopping member so as to cause the paper-sheet stopping member to swing with respect to the rotation shaft; and wherein the cam member comprises an operation part configured to operate the pressing member accompanying rotation of the cam member.

3. A paper-sheet post-processing device comprising:

a paper-sheet supporting unit which is arranged on a conveying route guiding a sheet of paper conveyed from an image forming device, configured to support the sheet of paper fed from the conveying route;

a staple unit, which is arranged at a standard position of the paper-sheet supporting unit, configured to execute binding processing of the sheet of paper supported by the paper-sheet supporting unit; and a paper-sheet aligning unit configured to align the sheet of paper supported by the paper-sheet supporting unit with the standard position, wherein the paper-sheet aligning unit comprises:

a main unit, which is disposed opposite to the paper-sheet supporting unit, comprising a first support part and a second support part that are arranged straddling the conveying route;

a paper-sheet holding part which is arranged on the main unit, configured to hold the sheet of paper supported by the paper-sheet supporting unit;

a cam mechanism, which comprises a cam member rotatably arranged on the main unit, configured to place the paper-sheet holding part close to and at a distance from the paper-sheet supporting unit by rotation of the cam member; and an aligning mechanism, which comprises an aligning member rotatable arranged on the main unit, configured to align the sheet of paper supported by the paper-sheet supporting unit with the standard position by rotation of the aligning member, wherein the main unit comprises a rotation shaft which is rotatably supported axially by the first support part and the second support part, wherein the cam member and the aligning member are arranged to be fixed to the rotation shaft, wherein the paper-sheet supporting unit comprises a first discharge roller at a discharge position opposite to the standard position, wherein the main unit comprises a discharging unit comprising a second discharge roller configured to be in pressure contact with and separated from the first discharge roller, and wherein the discharging unit causes the second discharge roller to move to a pressured position where the second discharge roller is in pressure contact with the first discharge roller and to a separated position where the second discharge roller is separated from the first discharge roller, accompanying rotation of the main unit.

4. The paper-sheet post-processing device according to claim 1, wherein the paper-sheet supporting unit comprises a first discharge roller at a discharge position opposite to the standard position, wherein the main unit comprises a discharging unit comprising a second discharge roller configured to be in pressure contact with and separated from the first discharge roller, and wherein the discharging unit causes the second discharge roller to move to a pressured position where the second discharge roller is in pressure contact with the first discharge roller and to a separated position where the second discharge roller is separated from the first discharge roller, accompanying rotation of the main unit.

5. The paper-sheet post-processing device according to claim 2, wherein the paper-sheet supporting unit comprises a first discharge roller at a discharge position opposite to the standard position, wherein the main unit comprises a discharging unit comprising a second discharge roller configured to be in pressure contact with and separated from the first discharge roller, and wherein the discharging unit causes the second discharge roller to move to a pressured position where the second discharge roller is in pressure contact with the first discharge roller and to a separated position where the second discharge roller is separated from the first discharge roller, accompanying rotation of the main unit.

* * * * *